US007878356B2

(12) United States Patent
Gartz et al.

(10) Patent No.: US 7,878,356 B2
(45) Date of Patent: Feb. 1, 2011

(54) CONVERTIBLE CONTAINER AND PLATE

(75) Inventors: Mark R. Gartz, Mt. Prospect, IL (US); Jeff Hautzinger, Chicago, IL (US); James N. Gomoll, Genoa City, WI (US); Craig E. Cappel, Lake Villa, IL (US)

(73) Assignee: Pactiv Corporation, Lake Forest, IL (US)

( * ) Notice: Subject to any disclaimer, the term of this patent is extended or adjusted under 35 U.S.C. 154(b) by 69 days.

(21) Appl. No.: 12/491,002

(22) Filed: Jun. 24, 2009

(65) Prior Publication Data

US 2010/0276419 A1 Nov. 4, 2010

Related U.S. Application Data

(63) Continuation-in-part of application No. 12/435,327, filed on May 4, 2009.

(51) Int. Cl.
*B65D 6/28* (2006.01)
*B65D 8/18* (2006.01)

(52) U.S. Cl. ..... 220/4.22; 220/574

(58) Field of Classification Search ..... 220/4.21–4.24, 220/6, 7, 326, 574, 575, 833–835, 837, 839; 229/406, 407; D7/538
See application file for complete search history.

(56) References Cited

U.S. PATENT DOCUMENTS 798,264 A 8/1905 Carrier
1,945,013 A 1/1934 Wilson
2,073,498 A 3/1937 Seez
2,170,040 A 8/1939 Stuart
2,232,088 A 2/1941 Waters (Continued)

FOREIGN PATENT DOCUMENTS

GB 2302533 1/1997

(Continued)

OTHER PUBLICATIONS

U.S. Appl. No. 12/435,327, filed May 4, 2009.

(Continued)

*Primary Examiner*—Harry A Grosso
(74) *Attorney, Agent, or Firm*—Baker Botts L.L.P.

(57) ABSTRACT

Foldable container including a base having a first base portion and an opposing second base portion. The base has a base surface free of hinge lines between the first base portion and the second base portion. A sidewall surrounds at least a portion of the base and extends generally upward from the base with a non-uniform height to define a compartment. A rim having a first rim portion and an opposing second rim portion is disposed proximate the top edge of the sidewall. At least one transition region is formed in the sidewall to allow the first base portion to pivot between an open position and a closed position. When in the open position, the container defines a plate. When in the closed position, the first base portion defines at least a portion of a cover relative to the second base portion. A packaged product is also provided, including a foldable container and a cover member removably attached to the rim of the foldable container in the open position to contain a product therein.

20 Claims, 22 Drawing Sheets

U.S. PATENT DOCUMENTS

| | | | |
|---|---|---|---|
| 2,252,297 | A | 8/1941 | MacIntyre |
| 2,468,306 | A | 4/1949 | Norden |
| 2,623,684 | A | 12/1952 | Collura |
| 3,033,434 | A | 5/1962 | Carson |
| 3,511,433 | A | 5/1970 | Andrews et al. |
| 3,596,822 | A | 8/1971 | Holley |
| 3,771,713 | A | 11/1973 | Davidson |
| 4,026,458 | A | 5/1977 | Morris et al. |
| 4,266,713 | A | 5/1981 | Maroszek |
| 4,441,626 | A | 4/1984 | Hall |
| 4,606,496 | A | 8/1986 | Marx et al. |
| 4,609,140 | A | 9/1986 | Van Handel et al. |
| 4,706,606 | A | 11/1987 | Coppola |
| 4,721,499 | A | 1/1988 | Marx et al. |
| 4,721,500 | A | 1/1988 | Van Handel et al. |
| 4,778,439 | A | 10/1988 | Alexander |
| 4,804,137 | A | 2/1989 | Harby |
| 4,848,543 | A | 7/1989 | Doboze |
| 4,890,576 | A | 1/1990 | James |
| 5,088,640 | A | 2/1992 | Littlejohn |
| 5,110,038 | A | 5/1992 | Pantisano et al. |
| 5,205,476 | A | 4/1993 | Sorenson |
| 5,209,392 | A | 5/1993 | Anatro |
| 5,230,939 | A | 7/1993 | Baum |
| 5,279,456 | A | 1/1994 | Bernstein |
| 5,326,020 | A | 7/1994 | Cheshire et al. |
| 5,577,989 | A | 11/1996 | Neary |
| 5,628,451 | A | 5/1997 | Neary |
| 6,364,203 | B2 | 4/2002 | Toussant et al. |
| 6,415,944 | B1 | 7/2002 | Toussant |
| 2008/0011758 | A1 | 1/2008 | Campbell |

FOREIGN PATENT DOCUMENTS

| | | |
|---|---|---|
| WO | WO9323294 | 11/1993 |

OTHER PUBLICATIONS

U.S. Appl. No. 29/346,225, filed Oct. 28, 2009.

CONVERTIBLE CONTAINER AND PLATE

CROSS REFERENCE TO RELATED APPLICATIONS

This application is a Continuation-In-Part of U.S. application Ser. No. 12/435,327, filed on May 4, 2009, the contents of which are expressly incorporated in their entirety herein by reference thereto.

BACKGROUND OF THE INVENTION

1. Field of the Invention

The present disclosed subject matter relates to a food packaging and system of a disposable container capable of converting into a plate. Particularly, the present disclosed subject matter is directed to a container for holding a food item, wherein the container is able to convert between open and closed positions. In the closed position, the container serves as a secure and reliable packaging carton. In the open position, the container unfolds or opens into a plate to allow for consumption of the food product.

2. Description of Related Art

A variety of containers are known for packaging of food products for secure shipping. Conventional food container designs include a base having a compartment to receive a food product, and a separate lid or cover member to be secured to the base to enclose the food product. Such conventional containers generally have been considered satisfactory for their intended purpose, however such assemblies often require a consumer to remove the food product from the base member in order to access the food product, e.g. with utensils. Consequently, merchants and/or consumers are required to provide a first container dedicated towards securely packaging and shipping the food product, and a second and separate plate for dining purposes. The need for a separate plate is disadvantageous in that it produces excessive waste, is not cost effective, requires extensive inventory, and presents an unnecessarily cumbersome system.

Some examples of prior art designs directed towards these features can be found in U.S. Pat. Nos. 6,415,944 and 6,364,203. However, these configurations require two hinge lines extending across the base portion of the container to define a spine about which the container can pivot between open and closed positions. The existence of such rigid hinge lines results in a point of weakness which can be prone to fracture. Such fracture is undesirable in that the container may be susceptible to leakage through the voids created by fracture if the hinge line is compromised. The hinge lines also may not be aesthetically pleasing, and can interfere with the placement of the food item in the container when the plate is in the open configuration.

As evident from the related art, conventional methods often require unnecessarily complex and excessively wasteful designs or are not robust enough to provide the requisite durability of a packaging container. There thus remains a need for an efficient and economic method and system for a disposable food container that securely encloses the food product, and yet is capable of converting into a plate.

SUMMARY OF THE INVENTION

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a foldable container comprising a base including a first base portion and an opposing second base portion. The base has a base surface free of hinge lines between the first base portion and the second base portion. A sidewall surrounds at least a portion of the base and extends generally upward a non-uniform distance from the base to define a compartment therein. The sidewall has an inner reference surface and a top edge. A rim is disposed proximate the top edge of the sidewall, wherein the rim defines a container depth of dimension D as measured from the base. A continuously varying sidewall height orients the base at an angle to the plane of the rim. The rim has a first rim portion corresponding with the first base portion and an opposing second rim portion corresponding with the second base portion. At least one transition region is formed in the sidewall to allow the first base portion to pivot between an open position and a closed position, wherein the first base portion defines at least a portion of a cover relative to the second base portion when in the closed position.

In a preferred embodiment, the transition region has a contoured surface when the first base portion is in the open position. For example, the contoured surface of the transition region is convex relative to the inner reference surface of the sidewall. The transition region has a boundary edge, which can be defined by a line of weakness, such as a score line or the like. Preferably, the boundary edge is generally symmetrical about a center line extending between the rim and the base. In embodiments having a non-uniform sidewall height, the boundary edge can extend different lengths in accordance with the varied sidewall height. Additionally or alternatively, the transition region can include a variation in a property of the sidewall, such as a variation in material, thickness, or strength. Likewise, a hinge can be defined between the first rim portion and the second rim portion to enable the first base portion to pivot relative to the second base portion. The hinge can include a groove formed in the rim.

In operation, a portion of the base between the first base portion and the second base portion has a generally arcuate configuration when the first base portion is in the closed position. A fastener and/or venting features can be disposed proximate at least one of the first rim portion or the second rim portion to maintain the first base portion in the closed position. Additionally or alternatively, the first rim portion and the second rim portion can form a substantially leak-resistant seal therebetween when the first base portion is in the closed position. If desired, the sidewall can define a plurality of sides, wherein at least one side has a non-linear configuration when the first base portion is in the open position and a substantially linear configuration when the first base portion is in the closed position. In this manner, the closed container can be positioned or displayed in an upright orientation. Additionally, the base can be formed with strengthening formations such as variation in material thickness or structural features to provide enhanced stability and strength at select locations, as well as product centering features, if so desired. Tabs can be included which extend outwardly from the periphery of the rim to facilitate opening of the container. A cover member formed of a film material can be removably attached to the rim of the container.

In accordance with another aspect, a packaged product is provided comprising foldable container with a product contained therein. Particularly, the foldable container comprises a base including a first base portion and an opposing second base portion, wherein the base has a base surface free of hinge lines between the first base portion and the second base portion; a sidewall surrounding the base and extending generally upwardly from the base to define a compartment therein; and a rim disposed proximate a top edge of the sidewall, wherein the rim has a first rim portion corresponding with the first base portion and an opposing second rim portion corresponding with the second base portion. The sidewall has at least one transition region formed therein to allow the first base portion to pivot between an open position and a closed position with the first base portion defining at least a portion of a cover relative to the second base portion when in the closed position. The packaged product further includes a cover member removably attached to the rim of the foldable container with the first base portion in the open position and the product contained within the compartment. In a preferred embodiment, the cover member includes a film material sealed to the rim of the foldable container.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Figure 1:
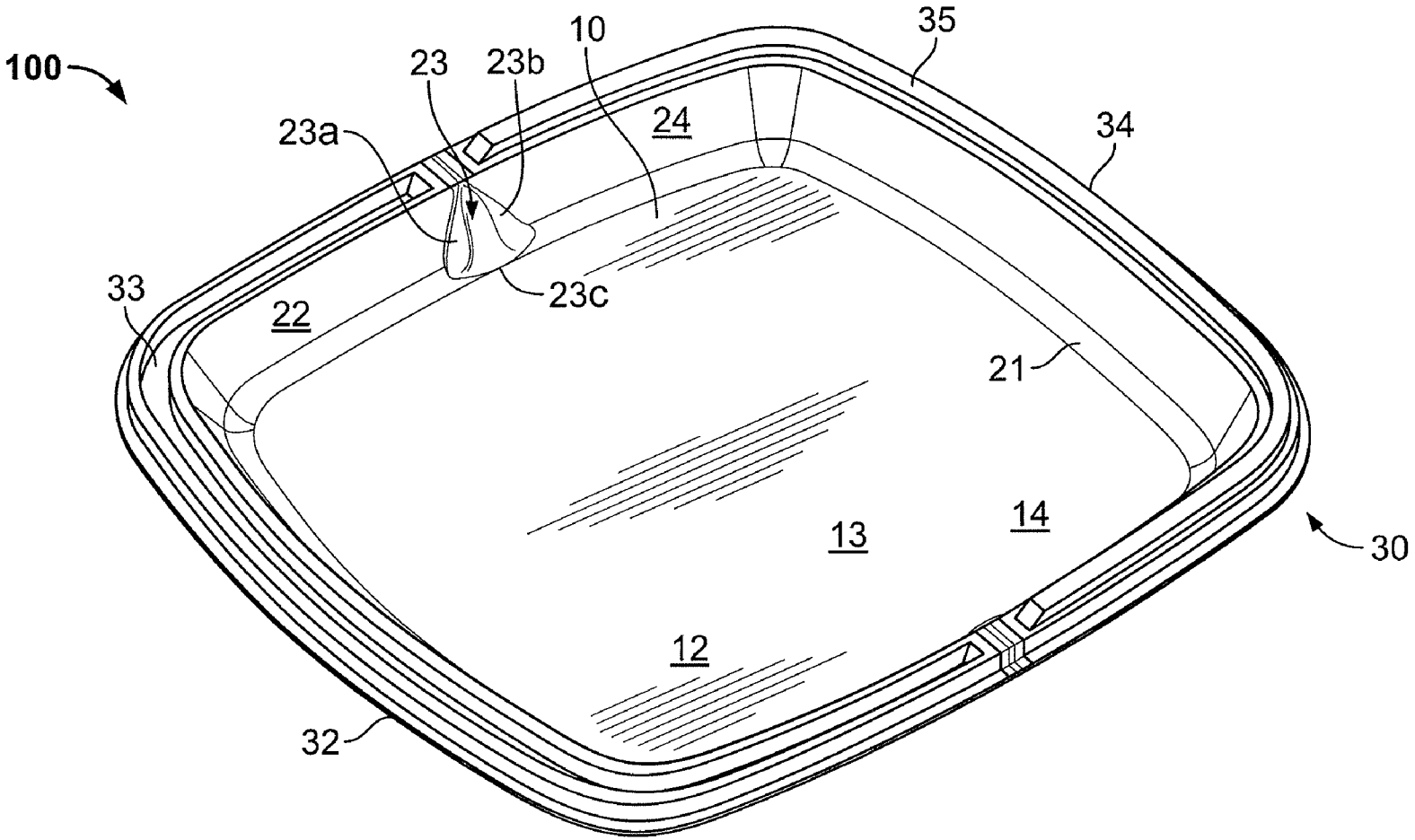
FIG. 1 is a perspective view of an exemplary embodiment of a foldable container in accordance with the disclosed subject matter, shown in the open configuration.

Reference will now be made in detail to the various exemplary embodiments of the disclosed subject matter, exemplary embodiments of which are illustrated in the accompanying drawings. The structure and corresponding method of operation of the disclosed subject matter will be described in conjunction with the detailed description of the system.

The apparatus and methods presented herein may be used for transport of food items and other perishable and nonperishable products. The disclosed subject matter is particularly suited for secure transport and storage of food items, wherein the container can convert between a closed position, in which the contents of the container are enclosed, and an open configuration in which the container serves as a plate for consumption of the food item. Also, a plurality of containers can be nested together in an open configuration for storage of empty containers, or the containers can be folded and stacked for separate or space efficient storage.

In accordance with the disclosed subject matter herein, the foldable container generally includes a base having a first base portion and an opposing second base portion. The base has a base surface free of hinge lines between the first base portion and the second base portion. A sidewall surrounds at least a portion of the base and can extend a non-uniform distance generally upwardly from the base to define a compartment therein. The sidewall has an inner reference surface and a top edge. A rim is disposed proximate the top edge of the sidewall, such that the rim has a first rim portion corresponding with the first base portion and an opposing second rim portion corresponding with the second base portion. The rim defines a container depth of dimension D as measured from the base. Furthermore, and as described below, the sidewall has at least one transition region formed therein to allow the first base portion to pivot between an open position and a closed position, such that the first base portion defines at least a portion of a cover relative to the second base portion when in the closed position. Using the foldable container, a packaged product is also provided, wherein a product is disposed within the compartment of the foldable container and a cover member is removably attached to the rim of the container when the first base portion is in the open position to contain the product within the compartment.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the foldable container in accordance with the disclosed subject matter are shown in FIGS. 1-19. The container is suitable for use with a wide variety of perishable and nonperishable products, such as flowers, garden supplies, hardware components, electrical items, and craft items. However, the foldable container disclosed herein is particularly suitable and beneficial for use with food items, wherein the foldable container can be used for shipping, serving, storing, preparing and/or re-using such food items. Further, the container desirably, although not necessarily, can have insulating properties to assist in maintaining the temperature of food contained therein. For purpose of illustration, and not limitation, reference will made herein to a foldable container intended to contain food items.

Figure 5:
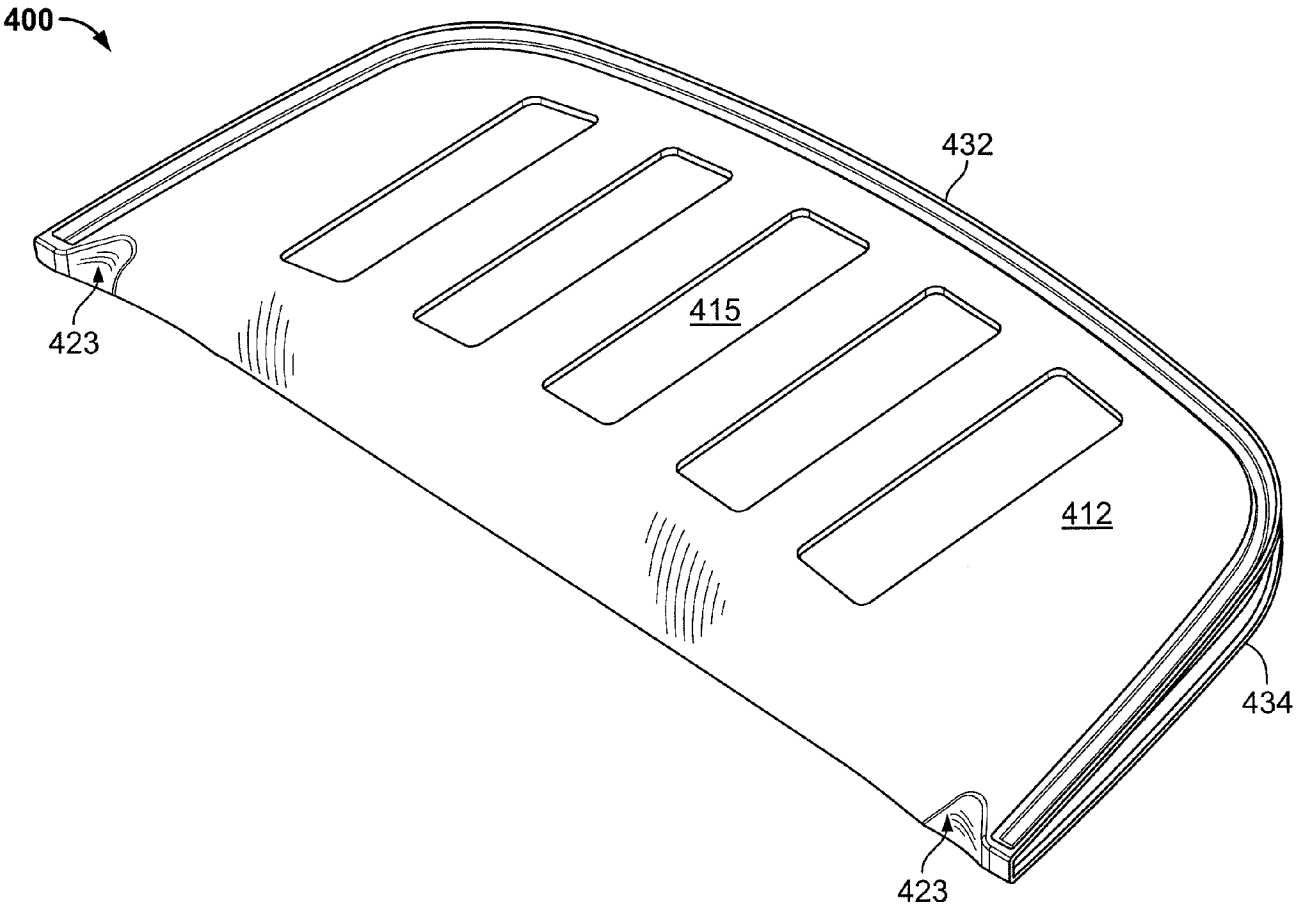
FIGS. 5-6 are perspective views of alternative embodiments of the foldable container, shown in the closed configuration and including strengthening formations.

In the exemplary embodiment shown in FIG. 1, the container 100 generally includes a base 10 having a first base portion 12 proximate one side of the base and a second base portion 14 proximate the opposite side of the base. The base further has a base surface free of hinge lines between the first base portion 12 and the second base portion 14. If desired, however, the base can be provided with features within the first and second base portions, such as wells, ribs, nesting features, or the like other than hinge lines. For example, and as shown in FIG. 5, the base can include strengthening features 415.

The container further includes an upwardly extending sidewall 20 surrounding the base 10. It is contemplated that the sidewall 20 can project upwardly generally at a right angle from the bottom or more preferably project both upwardly and outwardly from the base. The interface between the base and the sidewall can be a sharp angle, or an intermediate portion 21 can be provided for a smooth transition between base 10 and the sidewall 20. For example, and as shown in FIGS. 1, 7A and 7D, and 19-22, the intermediate portion 21, 621 and 721, respectively, is a radiused portion to blend the base and sidewall. The sidewall can be a generally smooth wall or can be provided with formations, such as textured surface or aesthetic designs or patterns, was well as indicia if desired. Additionally, the sidewall can include reinforcing ribs or structures (not shown) for additional strength, if so desired. Regardless of whether smooth or provided with formations, the sidewall defines an inner reference surface as described further below. Further, the sidewall can extend a non-uniform distance from the base to define a variable depth container, as discussed in further detail below with reference to FIGS. 15-19.

A rim 30 projects laterally outwardly from the top edge of sidewall 20, and generally includes at least a first rim portion 32 corresponding with the first base portion 12 and an opposing second rim portion 34 corresponding with the second base portion 14 as shown for purpose of illustration in FIG. 1. Additionally, as illustrated in the embodiment illustrated in FIGS. 15-19, the rim can be positioned adjacent to the intermediate portion at select sides of the container, as discussed in further detail below. The rim can have a variety of configurations to provide various advantages, including providing structural strength to the container. Additionally, the process of making the container, such as by thermoforming, can be simplified by including a rim on the container. Selected rim configurations are described further below.

Figure 2:
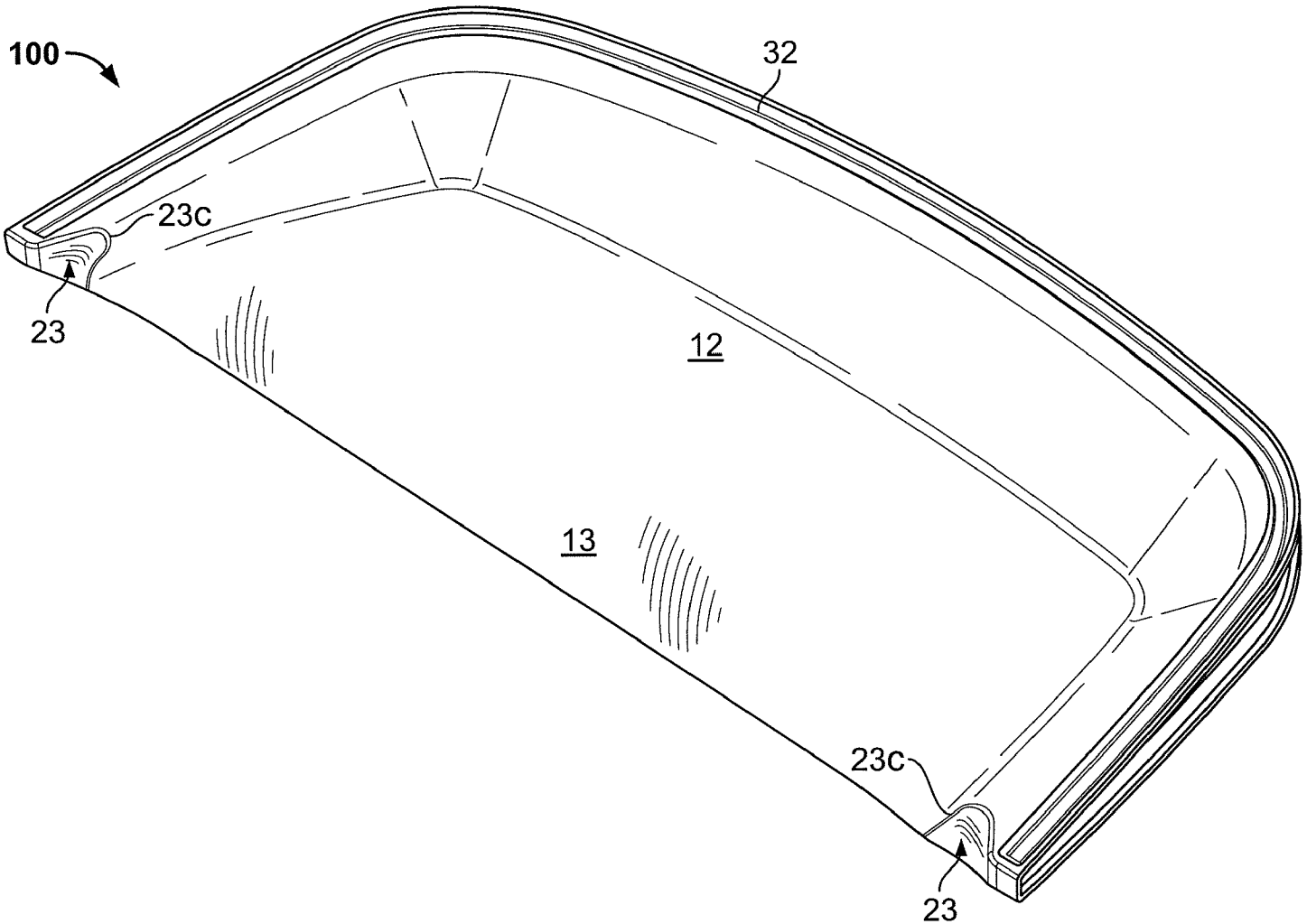
FIG. 2 is a perspective view of the foldable container of FIG. 1, shown in the closed configuration.

Further in accordance with the invention, at least one transition region 23 is formed in the sidewall 20. Particularly, and as shown in FIGS. 1-2, two transition regions 23 are provided, which generally divide the container into opposing portions. The transition regions serve to reduce and distribute the stress generated during the conversion from the open to the closed position, as discussed in further detail below. The first base portion 12 defines at least a portion of a cover relative to the second base portion 14 when in the closed position. It is to be understood that either portion 12, 14 of the container can be pivoted relative the other base portion without the need for hinge lines. In this manner, the container can be converted from an open position to a closed position a number of times without degradation of the structural integrity of the container.

The transition region 23 can be formed in the sidewall 20 in a variety of configurations. Generally, the transition region 23 defines a non-planar flexible joint or a pleat between the opposing portions of the container for pivotal movement therebetween. This non-planar configuration provides additional material which allows the container to convert from an open to a closed position. Optimally, the excess material focuses the stresses exerted on the container during the folding operation on the boundary edges 23*a*, 23*b*, as described in further detail below.

For example, and with reference to the representative embodiment of FIGS. 1-2, the transition region 23 extends inwardly from the inner reference surface of the sidewall to define a generally convex surface when in the open position. In this manner, the contoured surface generally defines a pleat in the sidewall providing additional wall material which allows the container to flex or fold between the open and closed positions. When the container is folded or converted to the closed position, the contoured surface of the transition regions 23 transitions in shape, such as into a flattened or even a concave configuration. Optimally, the excess material focuses the stresses exerted on the container during the folding to the boundary edges 23*a*, 23*b*. Additional or alternative contours can be formed. For example, the contoured surface can include a central convex region as shown in FIG. 1 to define an undulating surface. Alternatively, the contoured surface can extend outwardly from the sidewall 20 to define a concave surface relative to the inner reference surface of the sidewall 20 when the container is in the open position, which converts into a convex shape when the container is in the closed position.

Figure 3:
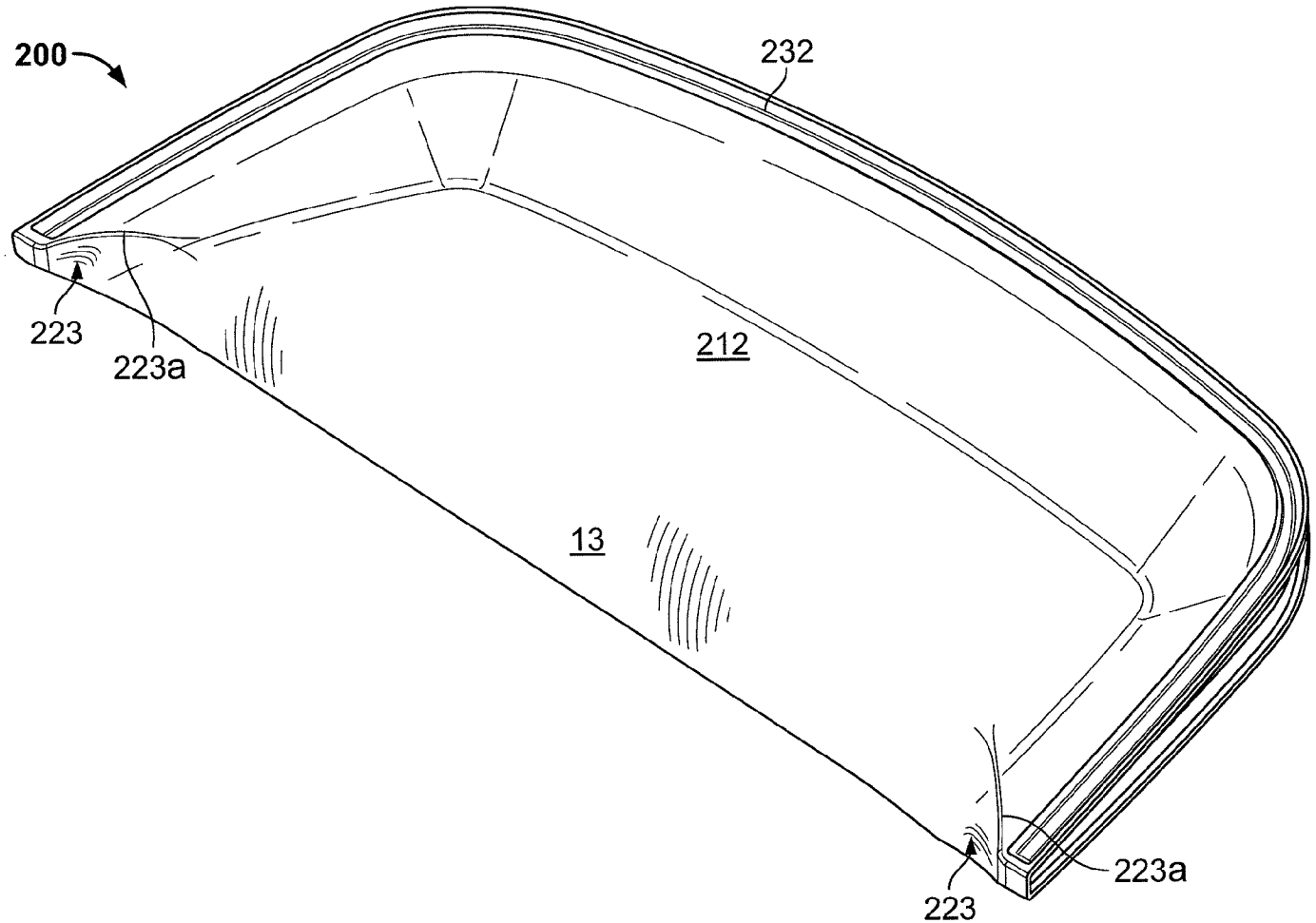
FIG. 3 is a perspective view of another embodiment of the foldable container, shown in the closed configuration, having a tapered transition region that seamlessly transitions into the base.
Figure 4:
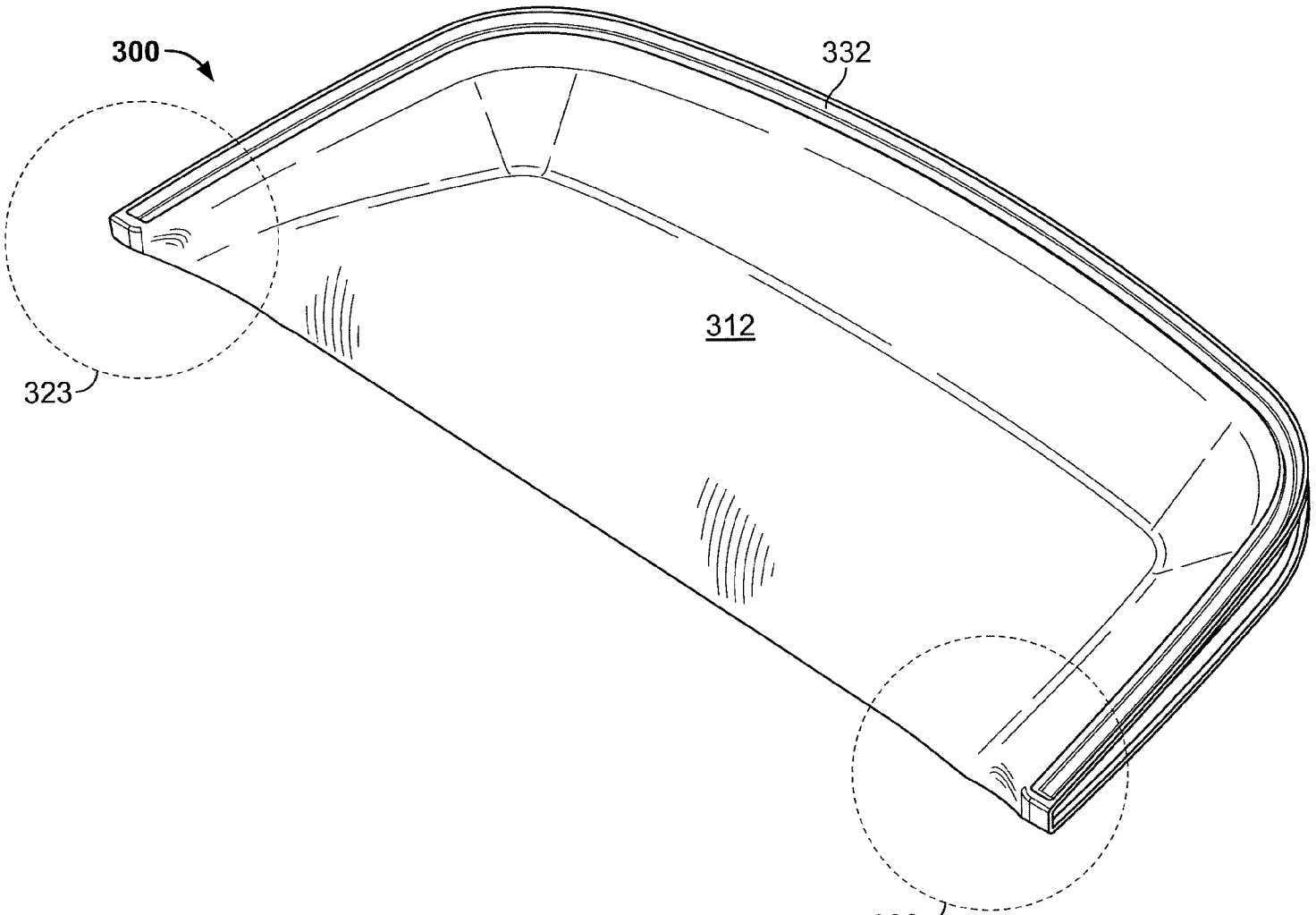
FIG. 4 is a perspective view of another embodiment of the foldable container, shown in the closed configuration, having a transition region of varied material properties formed in the sidewall.

The transition region 23 defines a boundary edge with the inner reference surface of the sidewall 20. For example, and as shown in FIGS. 1-2, boundary edges 23*a*, 23*b* extend between the rim 30 and the base 10 in a non-parallel, diverging manner. The boundary edges 23*a*, 23*b* can be one or more straight line segments, a continuous curve, such as an arc or parabola, or a combination of both. Additionally, and depending upon the shape of the transition region 23, a boundary edge can also be defined between the transition region 23 and the base 10 as shown in FIG. 1, or the transition region 223 can blend seamlessly into the base without defining a boundary edge therebetween as shown in as depicted in FIG. 3. If desired, a line of weakness can be provided along the boundary edge of the transition region 23, such as shown in FIG. 1. Preferably, the line of weakness reduces the bending force across the transition region and allows the container to fold in a predetermined manner. A variety of techniques are known and suitable for forming the line of weakness, such as score lines. Material can be cut or removed from the food container to form the transition regions. Preferably, however, material is compressed or densified to form the transition regions.

Figure 7A:
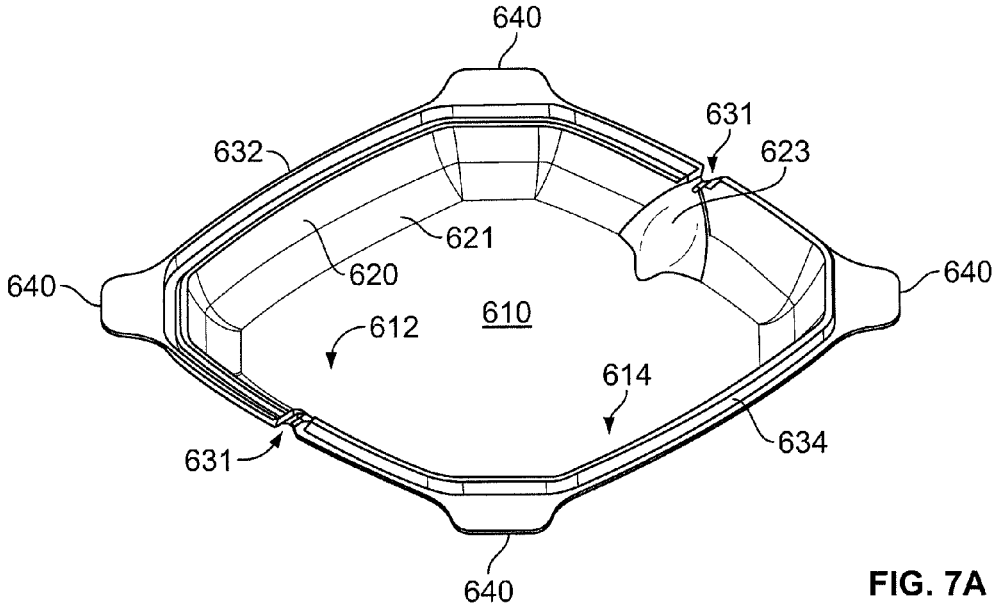
FIGS. 7A-D illustrate a perspective view, a top view and various cross sectional side views, respectively, of a preferred embodiment of the foldable container, shown in the open configuration, with a transition region having a contoured convex surface and including tabs extending from the rim.
Figure 7B:
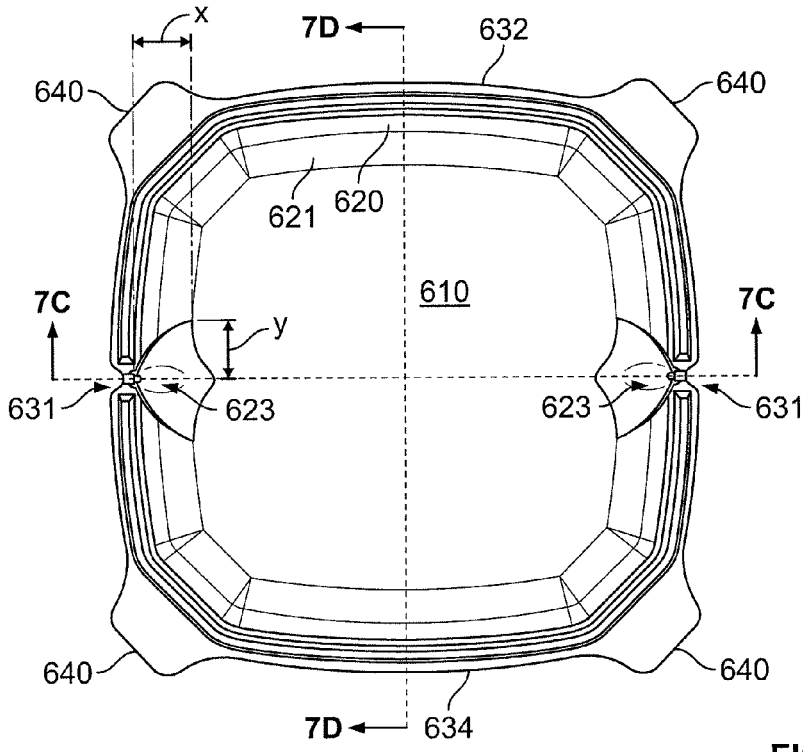
Figure 7C:
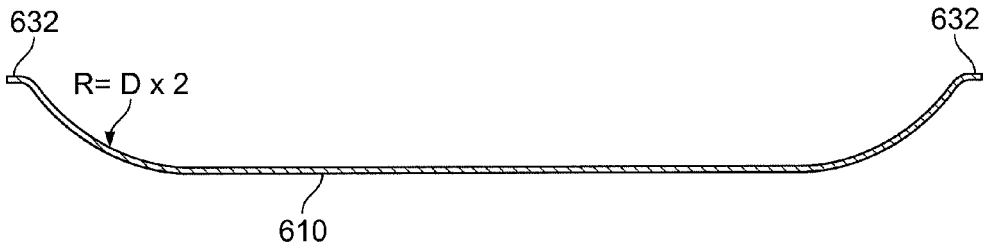
Figure 7D:
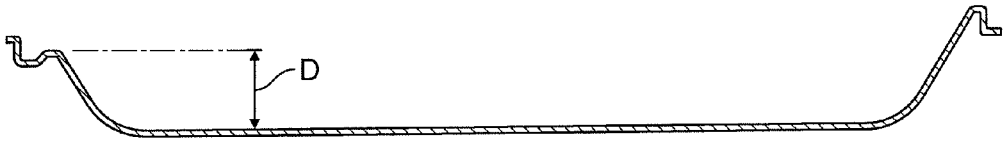

A preferred embodiment of a transition region 623 having a contoured surfaced is in accordance with the disclosed subject matter is depicted in FIGS. 7A-D. Generally, and as shown in FIG. 7D, the container includes a radiused intermediate portion 621 between the base 610 and sidewall 620, and has container depth "D" as measured between the base 610 and the rim 630. The transition region 623 has contoured surface that extends inwardly proximate the base a distance X from the rim as best shown in FIG. 7B, whereas the intermediate portion 621 is located inwardly from the rim a distance less than distance X. That is, the transition region 623 extends inwardly beyond the intermediate region 621. In a preferred embodiment, the distance X is about twice the depth dimension D. Furthermore, and as also best shown in FIG. 7B, the boundary edge of the transition region 623 is preferably symmetrical about a center line extending between the rim 630 and the base 610. In the exemplary embodiment illustrated, the boundary edges of transition region 623 are arcuate when viewed from above, and have a radius equal to twice the depth dimension D. The boundary edge of the transition region 623 extends a distance Y from the center line of the transition region proximate the base, and more preferably, the distance Y is generally equal to depth dimension D. With reference to the embodiment illustrated in FIGS. 15-19, the container depth "D" is defined as the distance between the base 710 and the rim 730, as measured along the centerline of the transition region 723.

A fillet is provided along the interface of the transition region 623 and the base 610 to smoothly blend from the center line of the transition region 623 to the boundary edge of the transition region 623 proximate the intermediate portion 621 of the container. The fillet is preferably provided with a continuous curved configuration as best shown in FIG. 7B. Similarly, the contoured surface is continuously curved. For example, and as shown in the preferred embodiment of shown in FIG. 7C, the cross-sectional shape of the transitional region 623 along its center line is defined generally by a radius of about twice the container depth D. The contoured surface thus has convex surface defined by a constantly variable conical blend from the center line to the boundary edge as depicted in FIG. 7A. Alternative blends, such as but not limited to cubic blends or the like, also can be used as desired for smooth transition across the contoured surface of the transition region 623.

In addition to or as an alternative to the use of contoured surfaces and lines of weakness, the transition region can include a variation in a property of the sidewall, such as a variation in material, thickness, or strength. For purpose of illustration and not limitation, the transition region 323 can be formed without employing any lines, but instead by varying the material properties of the container. As illustrated in FIG. 5, the transition region 323 can be defined by areas of reduced material thickness in the sidewall. Such a reduction in material thickness reduces the strength and rigidity of the transition region 323 thereby allowing for the first portion 312 of the container to pivot or fold over to engage the second portion 314 of the container. Similarly, the transition region 423 can be defined by areas of varying material thickness along the base, as shown in FIG. 5 and discussed in further detail below.

In accordance with an aspect of the disclosed subject matter, and again with reference to FIGS. 1-2, the transition region 23 generally defines opposing portions of the container, such that the base 10 includes a first portion 12 and a second portion 14. Likewise, and as depicted in FIG. 1, the sidewall 20 generally is defined as having a first portion 22 and an opposing second portion 24, and the rim 30 has a first portion 32 and an opposing second portion 34. Although the transition regions 23 are shown located at the midpoint of the container 100, for purpose of illustration, alternative locations of transition regions 23 are within the scope of the disclosed subject matter. Furthermore, one or more portions of the container can have a different size, thickness or shape than its opposing portion such that the two portions 12, 14 are asymmetrical to each other. In this manner, desired features and functions can be provided by this asymmetry, such as creating a gap between the portions for venting when the container is in the closed position. Additionally, each portion of the container can be configured to resemble a feature of a character, such as an animal, such that the container represents the character when in the closed position.

In accordance with another aspect of the invention, the sidewall can extend a non-uniform distance from the base to define a variable depth container. In the embodiment illustrated in FIGS. 15-19, the sidewall 730 extends generally upwardly from the base to define a continuously varying sidewall height. In some embodiments, the sidewall height can range from 0 inches along one side of the container, to approximately 1 inch along an opposing side of the container, with a continuously varying sidewall height spanning the distance between the two opposing sides. Preferably, the sidewall height varies in a linear fashion.

Figure 15:
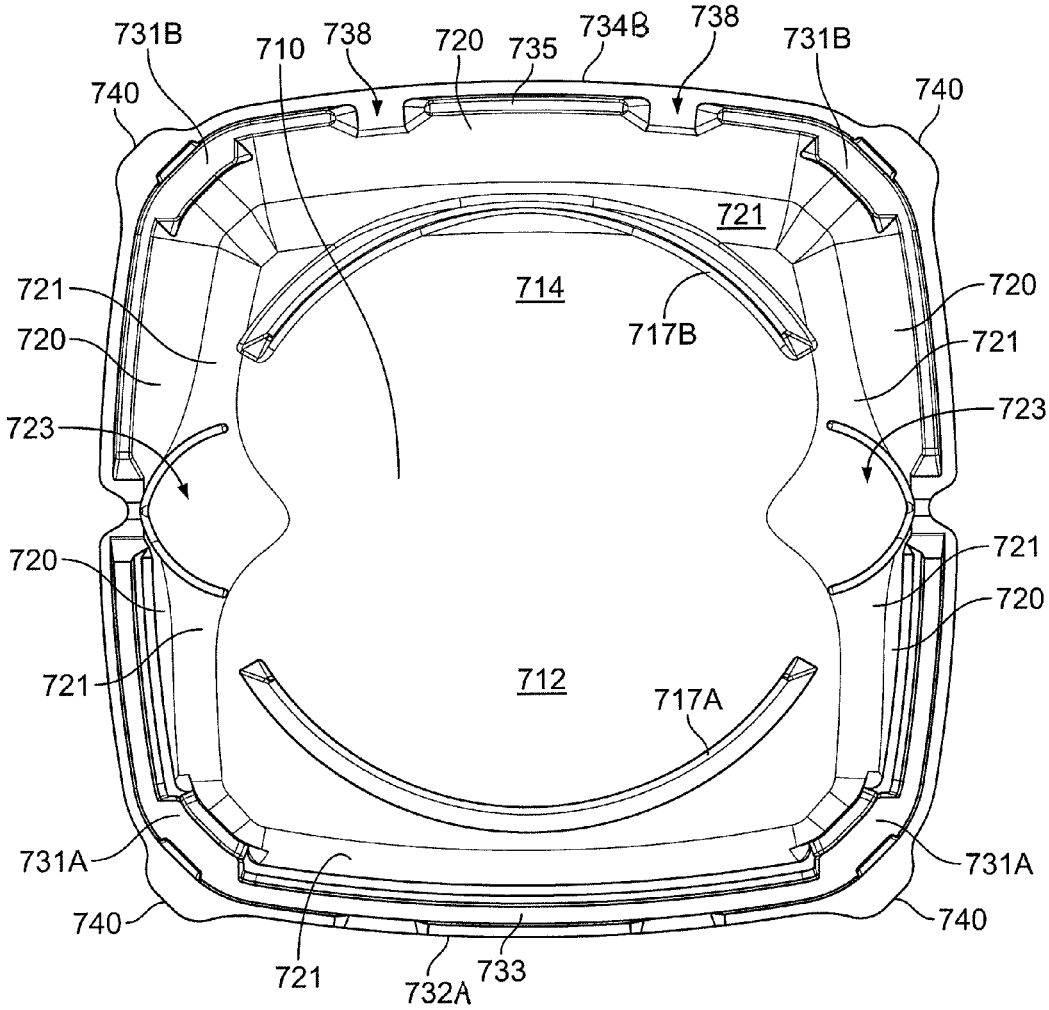
FIGS. 15-19 illustrate top, front, side, and various perspective views, respectively, of a preferred embodiment of the foldable container, shown in the open configuration, with a sidewall having a varying height.
Figure 16:
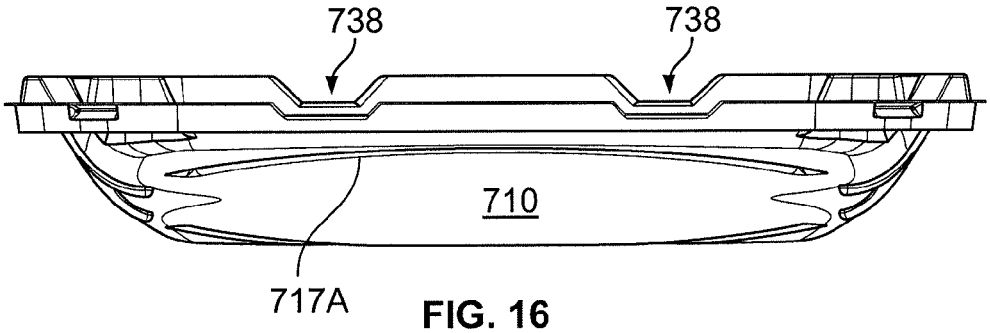
Figure 17:
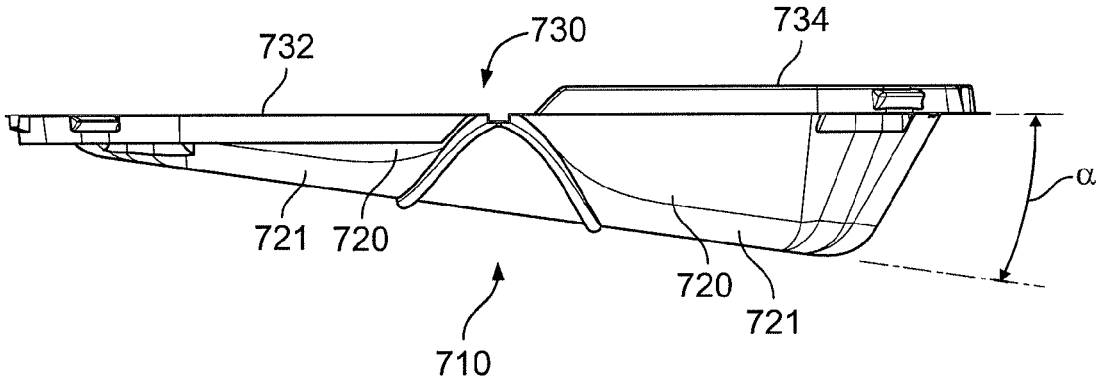
Figure 18:
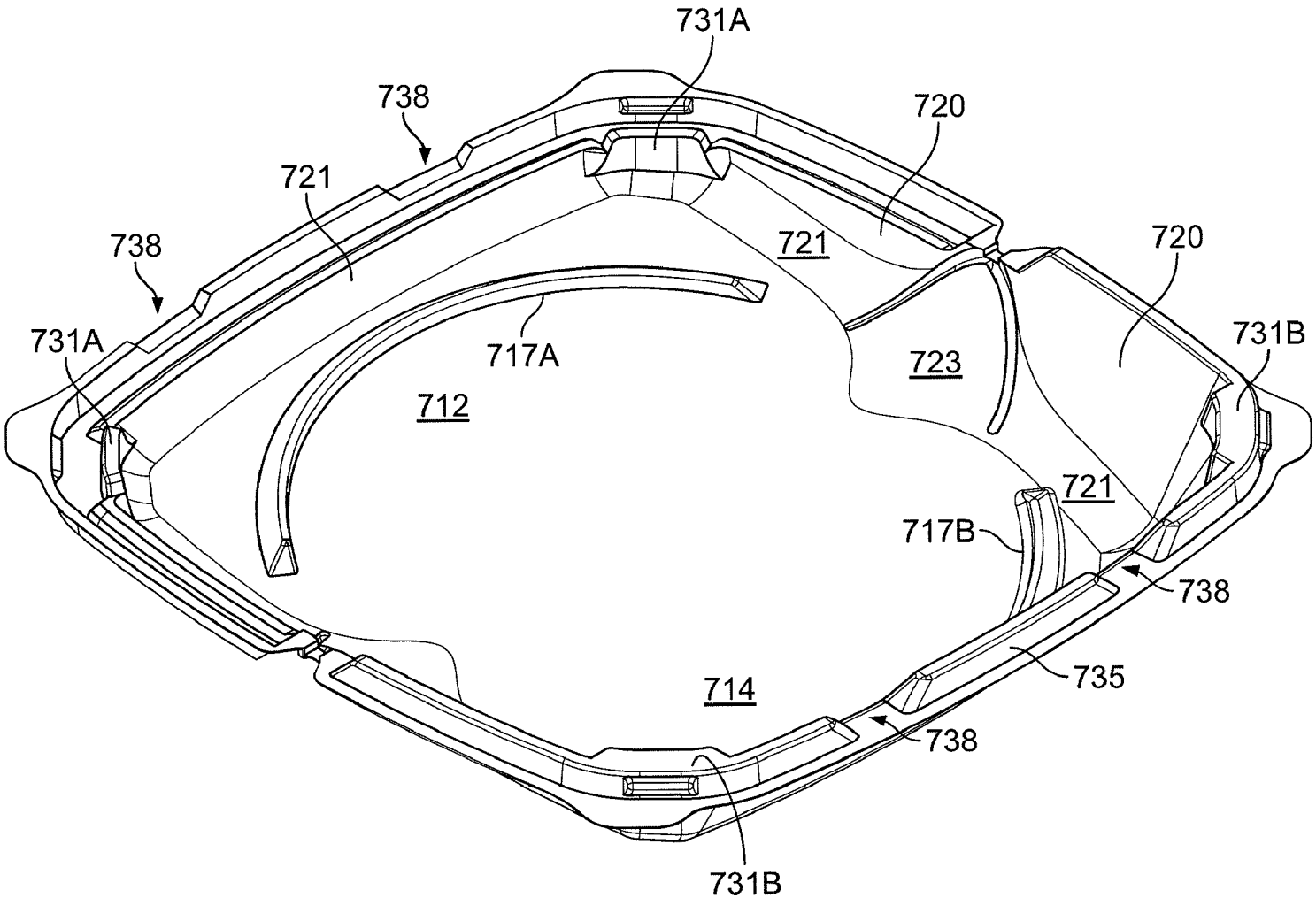
Figure 19:
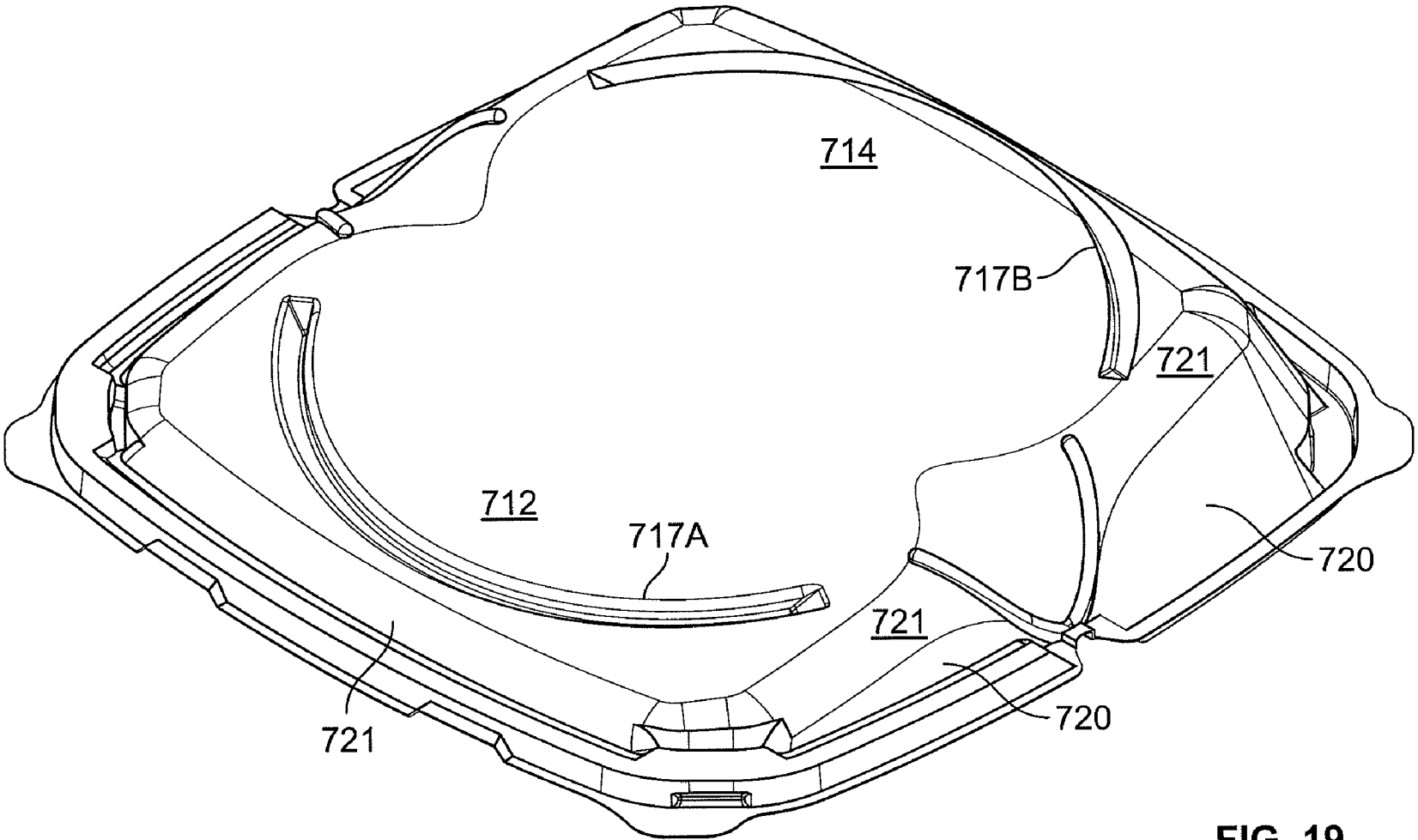

In the embodiment illustrated in FIGS. 15-17, a segment of rim 732A is disposed adjacent the top of the intermediate portion 721 along a first side of the container. The remainder of the rim 730 is disposed at the top edge of the sidewall 720, which has a varying height as it circumscribes the base. As such, opposing rim 734B is disposed adjacent the top edge of the sidewall 720, which extends approximately 1 inch from the base 710. Preferably, the sidewall portion spanning the distance between these opposing sides is configured with a constant slope. Additionally, the container can be configured such that a sidewall is omitted from a select side(s) of the container (i.e. sidewall height is 0 inches) with the remaining sides having a sidewall extend generally upward a non-uniform distance.

Accordingly, and as illustrated in FIG. 17, the container with a non-uniform sidewall height is configured with a rim 730 which is planar and parallel to a vertical axis, when the container is oriented vertically. Likewise, the non-uniform sidewall height provides a base 710 which is oriented at an angle $\alpha$ with respect to the plane defined by the rim 730. Thus, when the container is in the closed configuration, the first portion 712 is oriented at angle $\alpha$ with respect to the second portion 714. In a preferred embodiment, the angle $\alpha$ is approximately 8°. Also, first portion 712 and second portion 714 retain a planar configuration when the container is in the closed position.

Further, transition region 723 can be formed having a contoured surfaced as discussed above. Accordingly, the boundary edge which defines transition region 723 is preferably symmetrical about a center line extending between the rim 730 and the base 710 as shown in FIG. 15. Further, the boundary edges 723*a*, 723*b* of the transition region can extend different lengths due to the varying sidewall height, with the boundary edge 723*b* disposed at position of greater sidewall height having a greater length than boundary edge 723*a* such that both boundary edges extend the same distance into the intermediate portion 721, as shown in FIG. 17.

While particular dimensions and arrangements are described in reference to the preferred embodiments, it is to be understood that alternative configurations and sizes are considered to be within the scope of the disclosed subject matter. For example, the non-uniform sidewall height of the disclosed subject matter can be embodied in discrete sidewall portions having abrupt or stepped variations in height. Similarly, the non-uniform sidewall height can be embodied by an undulating patter of peaks and valleys circumscribing the container, or portions thereof.

In operation, the first portion 12 of the base is rotated or pivoted, such that the first portion 12 of the base serves as a cover to enclose a food item or other product contained within the container. When the container is in the closed position, the portion 13 of the base 10 that coincides with the transition region, i.e. the portion between first base portion 12 and second base portion 14, generally has an arcuate cross-sectional shape, as best illustrated in FIG. 2. This arcuate cross-sectional shape more uniformly distributes the stress resulting from the folding process, so as to minimize or eliminate stress concentrations associated with hinge lines in conventional containers. In one embodiment, this arcuate cross-sectional shape forms a parabola having a focus point disposed within the container interior and in-plane with the rim 30. The resulting shape of the base portion 13 between the first 12 and second 14 opposing portions will depend upon the depth D of the container, as measured from the base 10 to the rim 30, and the shape and material of construction of the transition region.

Figure 6:
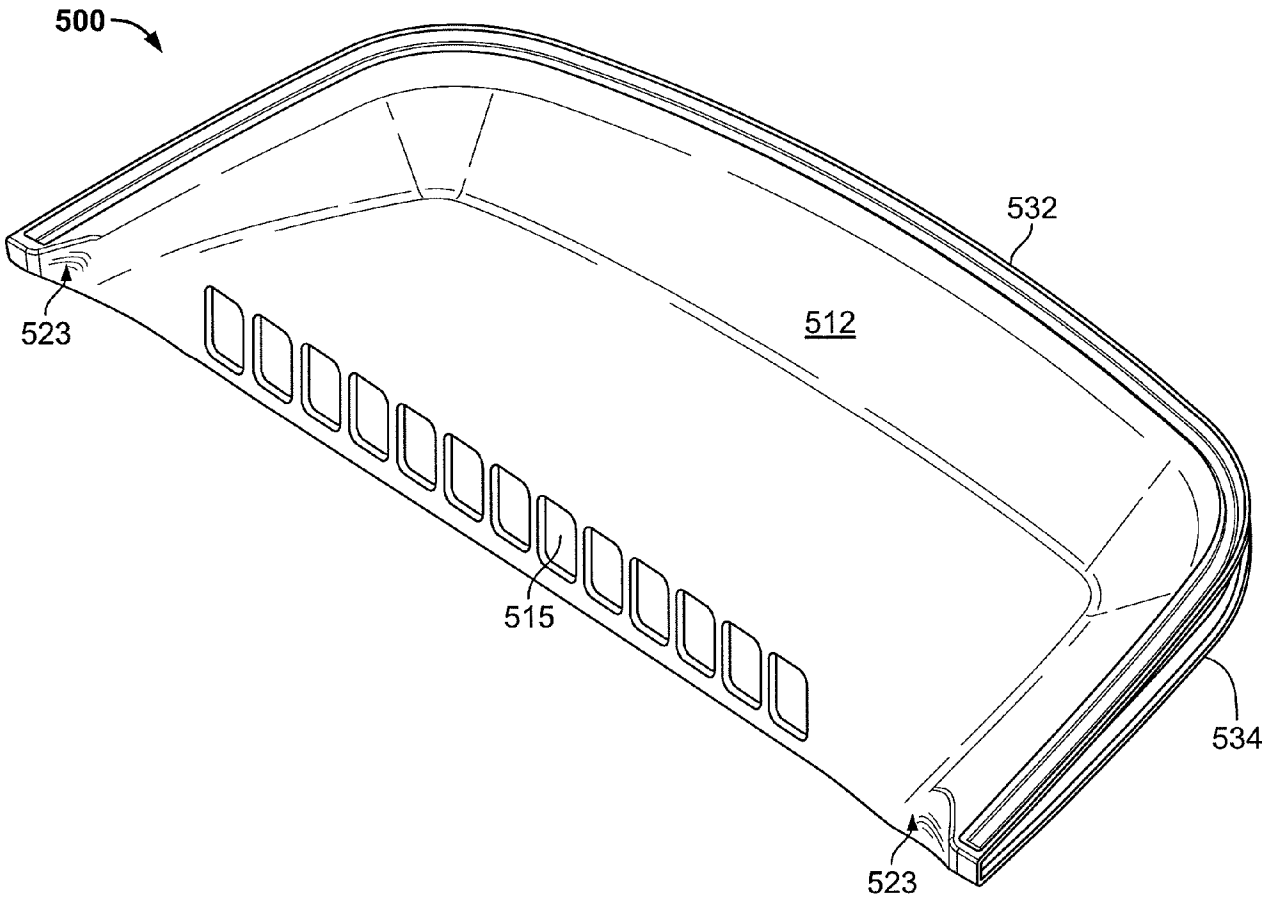

An additional advantage of eliminating any hinge lines between the first and second base portions is to provide a container that can be opened from the closed position to form a plate having a smooth base surface substantially free of undesirable disruptions. Hence, a product or menu item can be positioned within the container and initially sold in the closed position as shown in FIG. 2. The consumer opens the container by rotating the first portion 12 of the base to the open position with the first base portion 12 in plane with the second portion 14. The container base 10 thereby can be used as a plate for easy consumption by the consumer. If desired, however, certain features or formations, such as strengthening features, can be incorporated into the base of the container. For instance, at least one of the portions 412, 414 of the base can be formed with panels 415 to provide additional rigidity and enhanced structural integrity of the container, as shown in FIG. 5. Similarly, a plurality of strengthening features or panels 515 can be formed along the transition region as shown in FIG. 6. The strengthening panels 15 can be formed by geometric structures, e.g. ribs, or by varying the material thickness at select locations.

Additionally, a product centering feature can be formed in the base 10. Particularly, a first product centering feature 717A can be formed in the first portion 712 of the base, and a second product centering feature 717B can be formed in the second portion 714 of the base ss illustrated in FIGS. 15-19, if so desired. The product centering feature can be raised or elevated with respect to the base 710, and is sized to receive the food product such that the a uniform space is provided between the edge of the food product and the interior of the sidewall 720. This space is advantageous for centering the food product for display and allowing a consumer to easily and securely transition the container between open and closed positions, without interference or obstruction from the food product. Further, in some applications, this space between the product centering feature and the sidewall 720 can serve as a channel or reservoir for accumulating any juices or seepage from the food items placed within the container or debris otherwise present within the container. In some embodiments the product centering feature 717A-B can be configured as rib which extends along the base 10 to provide enhanced strength and rigidity.

As previously noted, a rim can be disposed at the top edge of the side wall. The rim includes a first rim portion corresponding with the first base portion and an opposing second rim portion corresponding with the second base portion. The rim 30 can completely surround the perimeter of the container as shown for purpose of illustration in FIG. 1, or can be separate segments 632, 634 such as shown in the representative embodiment of FIG. 7A-D. Preferably, a hinge is defined between the first rim portion and the second rim portion. For example, if the rim completely surrounds the perimeter of the container, the hinge can be defined by a groove, notch, score line or the like to form a living hinge as known in the art and shown for purpose of illustration in FIGS. 1, 9A and 11A. Alternatively, the hinge can be defined by a gap existing between the first and second rim portions, as depicted in the representative embodiment of FIGS. 7A-D.

Figure 8A:
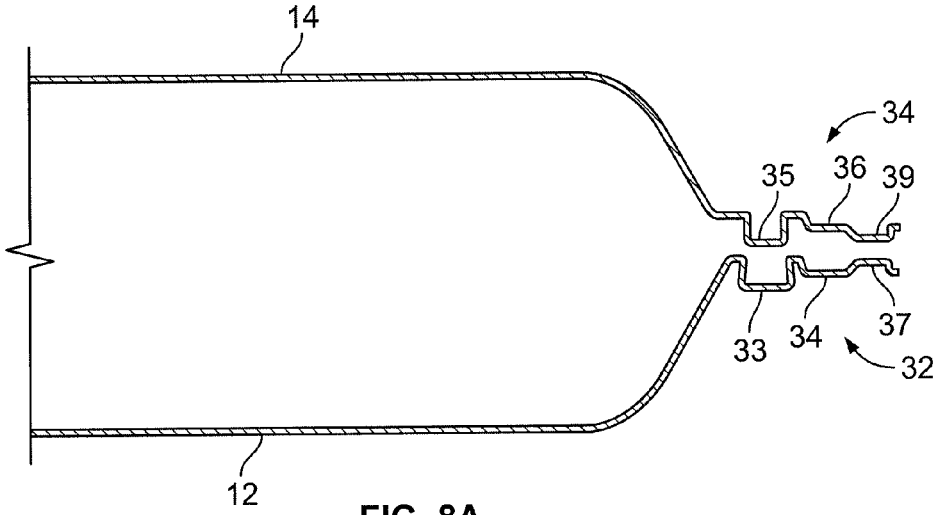
FIG. 8A-C are enlarged cross-sectional side views depicting operation of a fastener assembly for the foldable container in accordance with the disclosed subject matter.
Figure 8B:
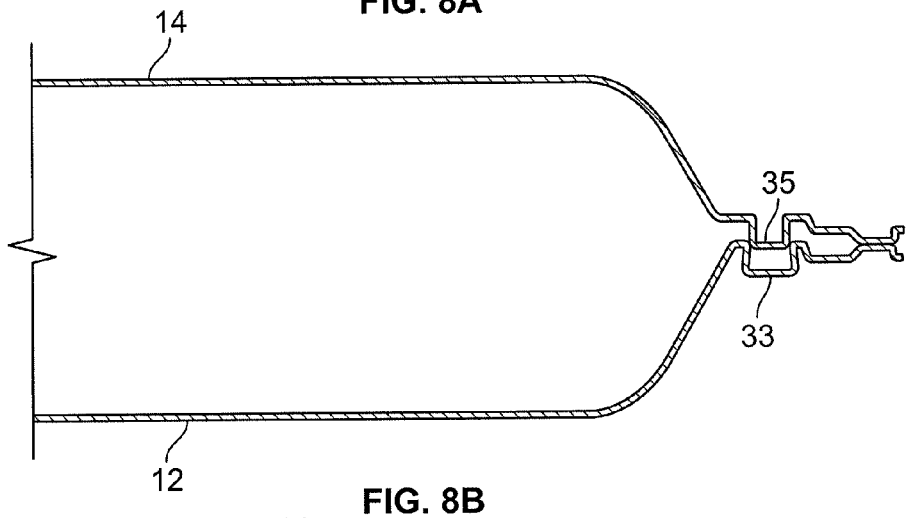
Figure 8C:
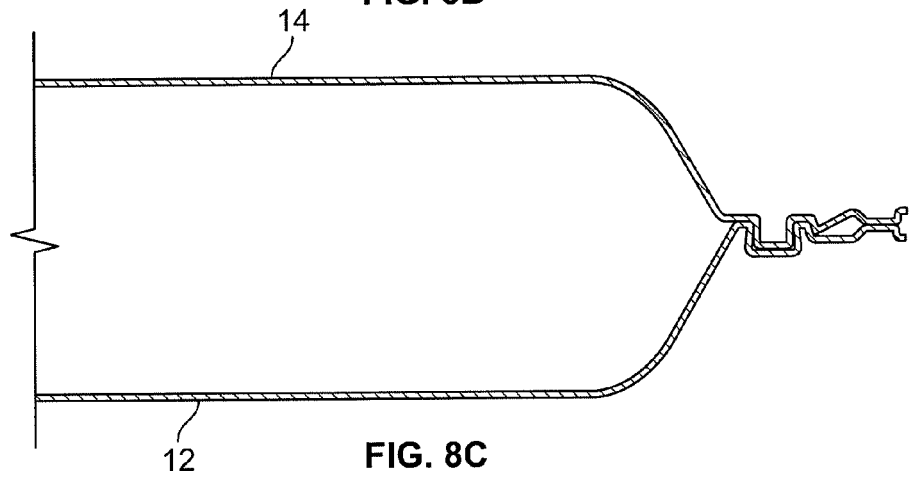

In accordance with another aspect of the disclosed subject matter, the rim 30 can be formed with a fastening feature to securely lock the container in the closed position, if so desired. In one preferred embodiment, as shown in FIGS. 1-9, the first rim portion 32 includes a recess 33 which extends around the periphery of the first rim portion 32 and is sized to receive a protrusion or tongue 35 formed within the second rim portion 34. FIGS. 8A-C illustrate a cross-sectional view of the container in which the second portion 14 is pivoted or rotated about the transition region (not shown) to be positioned above the first portion 12 and thereby serve as the cover.

In this configuration, the protrusion 35 is received within the recess 33, preferably with an interference fit that forms a leak-resistant seal between the two rim portions to prevent fluids or debris from passing through the container. Additionally, each rim portion 32, 34 can include a flex region 34, 36 and a closure 37, 39 which define a fastener assembly. Further, each element of the fastener assembly (e.g. recess 33, flex region 34, and closure 37) can be arranged at a different depth relative to a reference surface which lies in plane with the top edge or the sidewall. In operation, when the protrusion 35 is inserted within recess 33 to form a seal, the flex region 34, 36 located between the seal and the closure 37, 39 can deform outwardly to eliminate any gaps between the rim portions 32, 34.

Additionally, the rim can be formed with a plurality of vent features to permit circulation of air and venting of the contents stored within the container, when the container is in the closed position. As illustrated in FIGS. 15-19, the plurality of vent features can be formed as channels or slots 738 formed in either the protrusion 735 or the recess 733 portions of the rim 730, or alternatively in both elements if so desired. The number, size and location of the vent features can be varied as necessary to achieve the desired amount of venting.

As an alternative, or in addition to the fastening assembly described above, the container can be formed with one of a variety of latching or closure mechanisms. For example, and as illustrated in FIGS. 15-19, locking features 731A,B can be incorporated into the fastening assembly and provided to matingly engage when the container is converted into the closed position. The number, size and location of the locking features can be varied as necessary to achieve the desired locking force. Additionally, other closure mechanisms known to those skilled in the art can be substituted or combined with the fastening assembly described above. For example, the container may be releasably latched by a latching mechanism described in U.S. Pat. No. 5,758,791, the entirety of which is hereby incorporated by reference. Releasably latched is defined herein as including snap engagements, firmly-held engagements and substantially leak-resistant engagements. It is contemplated that the first and second portions of container 100 of the can be releasably latched by other known latching mechanisms, such as that described in U.S. Pat. No. 5,607,709, the entirety of which is hereby incorporated by reference.

Figure 9A:
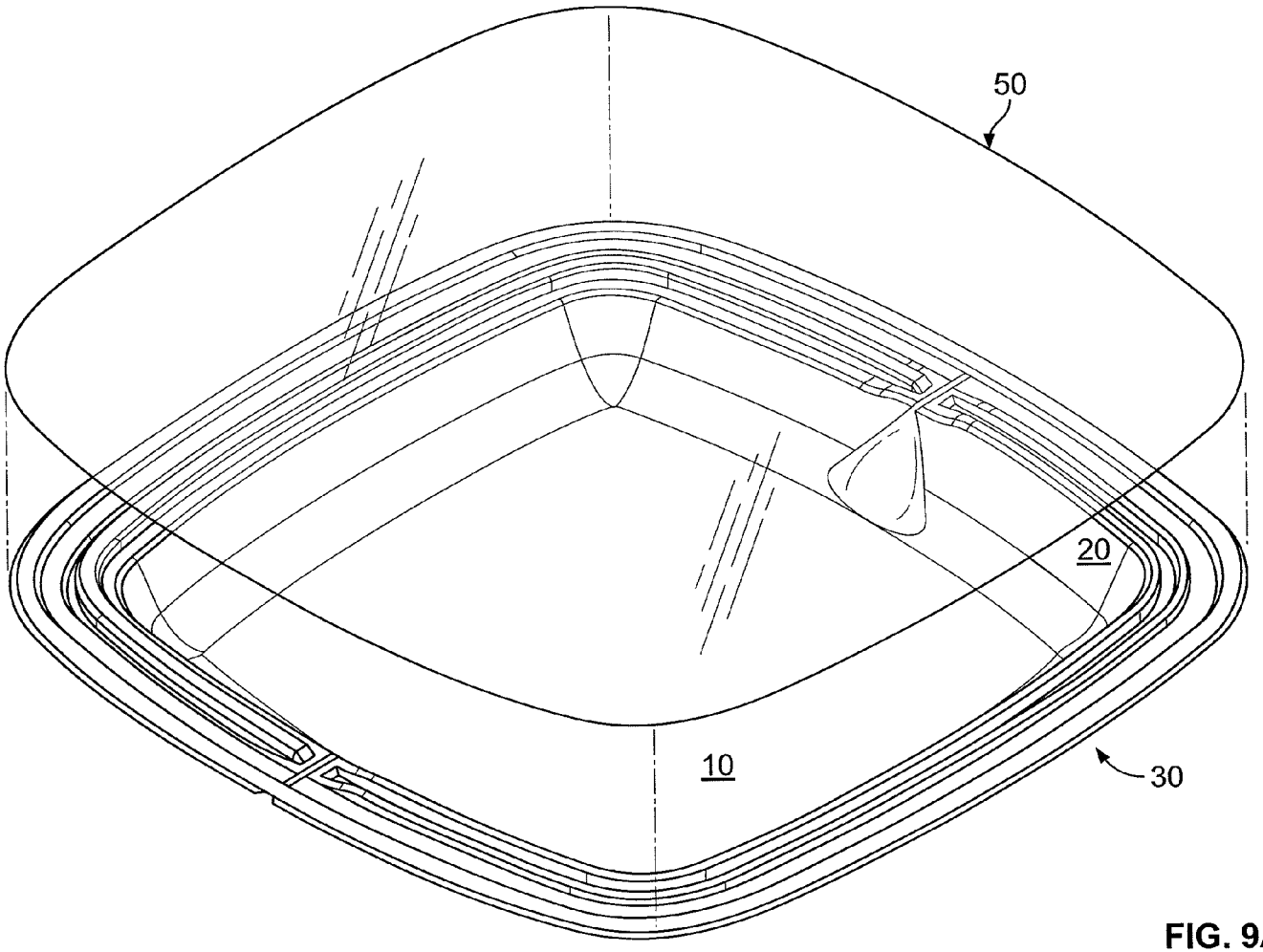
FIG. 9A-B are an exploded view and an assembled view, respectively, of the foldable container with a removable cover member in accordance with the disclosed subject matter.
Figure 9B:
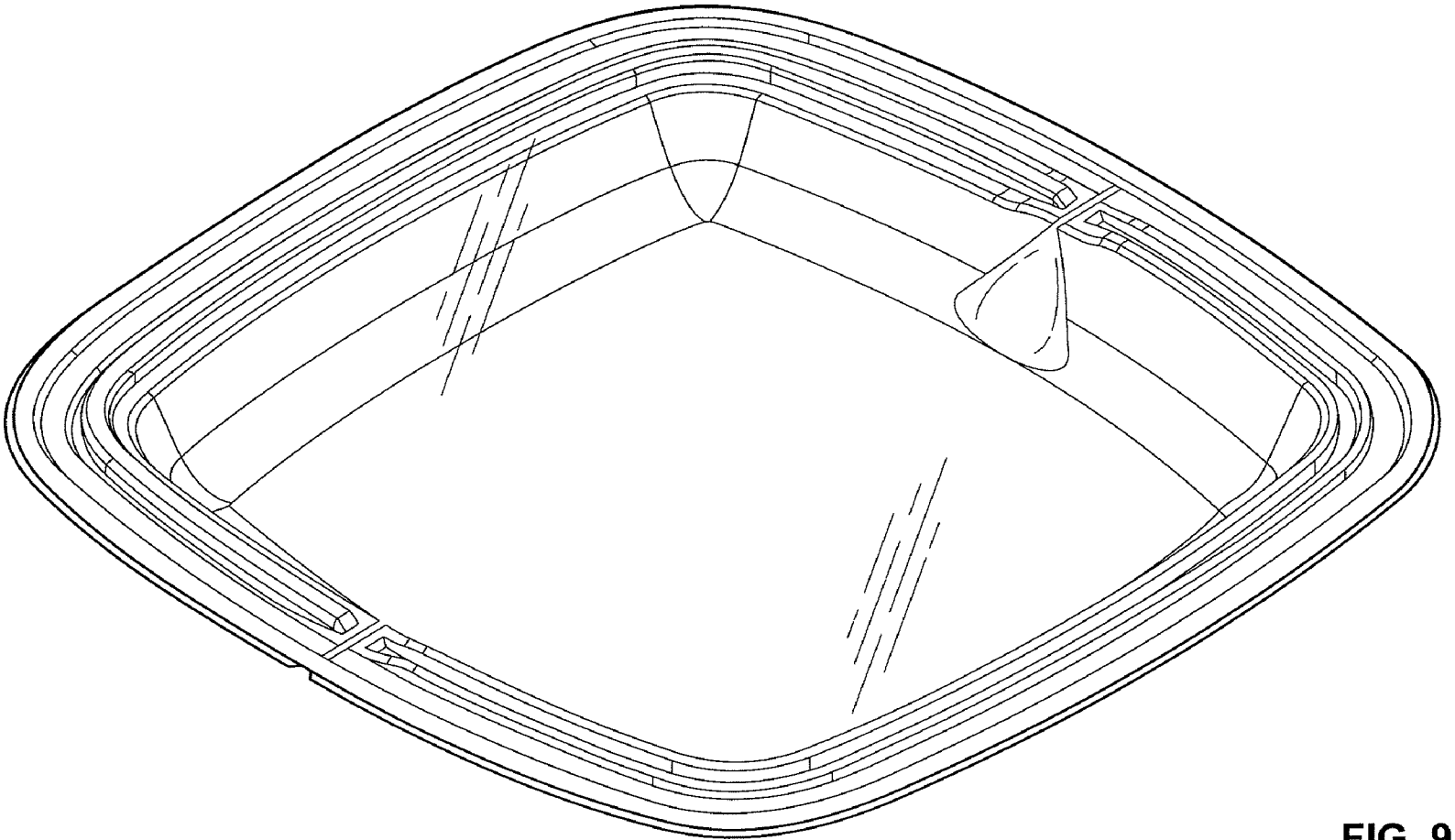

Additionally, tabs can be formed to extend outwardly from the periphery of the rim to assist in the opening and closing of the container. For example, and with reference to the representative embodiment of FIGS. 7A-B, 19-22 tabs 640 and 740, respectively, can be formed at the periphery at select edges of the container. Each tab 640, 740 can be formed to extend a equivalent distance from the container, or select tabs 640, 740 can be formed to extend different distances such that when two tabs are brought into engagement, i.e. when the container is in the closed position, a first tab 640, 740 may extend outwardly a greater distance than the adjacent tab so as to provide a grip for the consumer which facilitates opening of the container. Additionally, tabs 640,740 can further incorporate latching features, as described above In accordance with another aspect of the disclosed subject matter, a packaged product is provided including a foldable container having a base, sidewall, and rim as discussed above, and further including a cover member 50 removably attached to the rim 30 when the first base portion 12 is in the open position to contain the product within, as shown in FIGS. 9A-B. In such embodiments, the container can be initially configured in the open position having food items disposed within the container and the removable cover member 50 extending across the container to at least partially enclose the food items. This removable cover member 50 allows for the container to be presented in the open position and therefore provides increased visibility and display of the food item in the event that the container is opaque, while simultaneously preventing any undesired contact with the food items. Additionally, the use of a cover member 50 allows a processor in an in-line automated manufacturing process to form sealed containers without performing a folding operation. A user can then remove the cover member 50 and access the food items, and thereafter convert the container into the closed position to retain any unconsumed food items in a convenient transport or storage container.

In a preferred embodiment, the cover member 50 is formed from a flexible transparent film, although alternative designs such as and films including various indicia or product labels, foils, plastics, etc., are considered to be within the scope of the disclosed subject matter. The cover member 50 can be attached to the container 100 in a variety of ways including heat sealing, ultrasonic welding, adhesives, cohesion, etc., as so desired. Alternatively, the cover member 50 can be formed as a rigid lid. In some embodiments, a second container can serve as a removable lid in which the rim of the second container is configured to engage the rim of the first container.

Figure 10A:
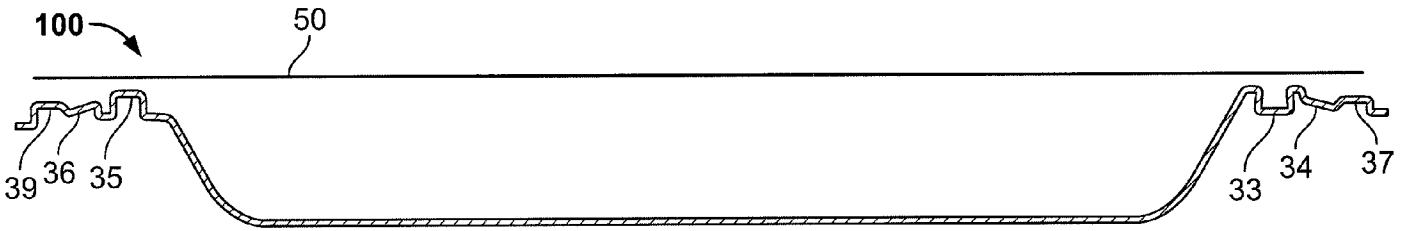
FIG. 10A-C are cross-sectional side views depicting assembly of the foldable container with removable cover member of FIGS. 9A-B.
Figure 10B:
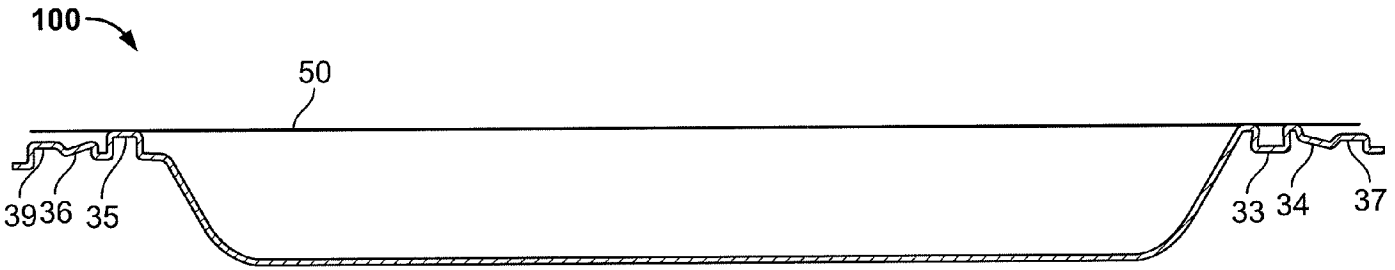
Figure 10C:
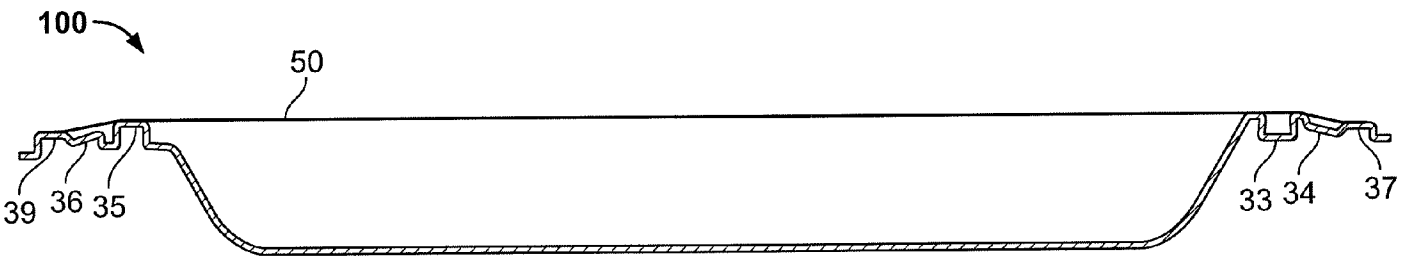

FIGS. 10A-C illustrate a cross-sectional view of the process of applying a cover member to the container 100 of FIGS. 9A-B. As illustrated, the removable cover member 50 can extend over the fastener assembly (i.e. seal 33, 35; flex regions 34, 36; and closures 37, 39). As discussed above, the relative depths of the recess 33, flex region 34, and closure 37 can be varied such that each element can lie within the same plane, or be positioned at varying depths as so desired.

Figure 11A:
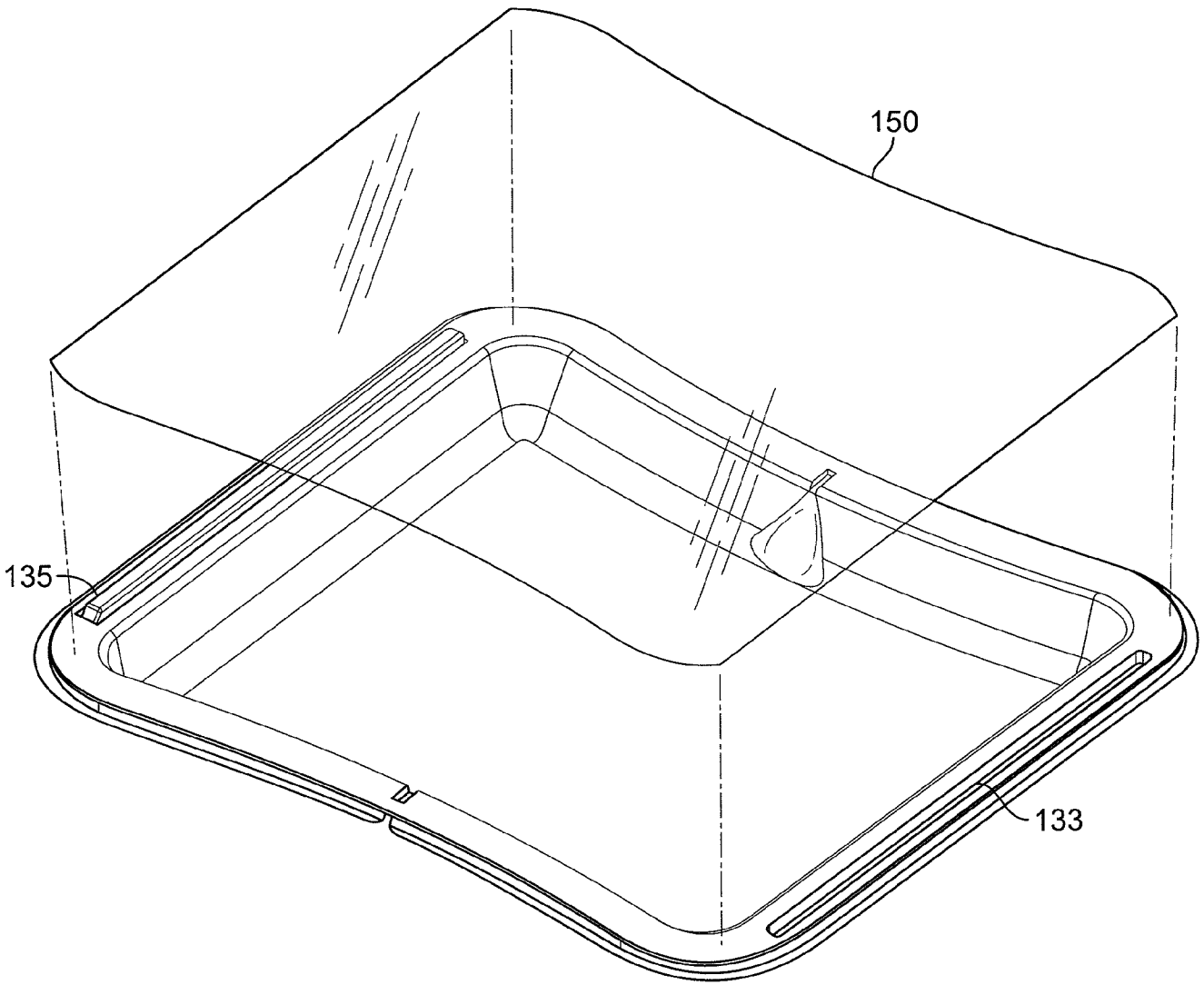
FIG. 11A-B are an exploded view and an assembled view, respectively, of another embodiment of the container and removable cover member in accordance with the disclosed subject matter.
Figure 11B:
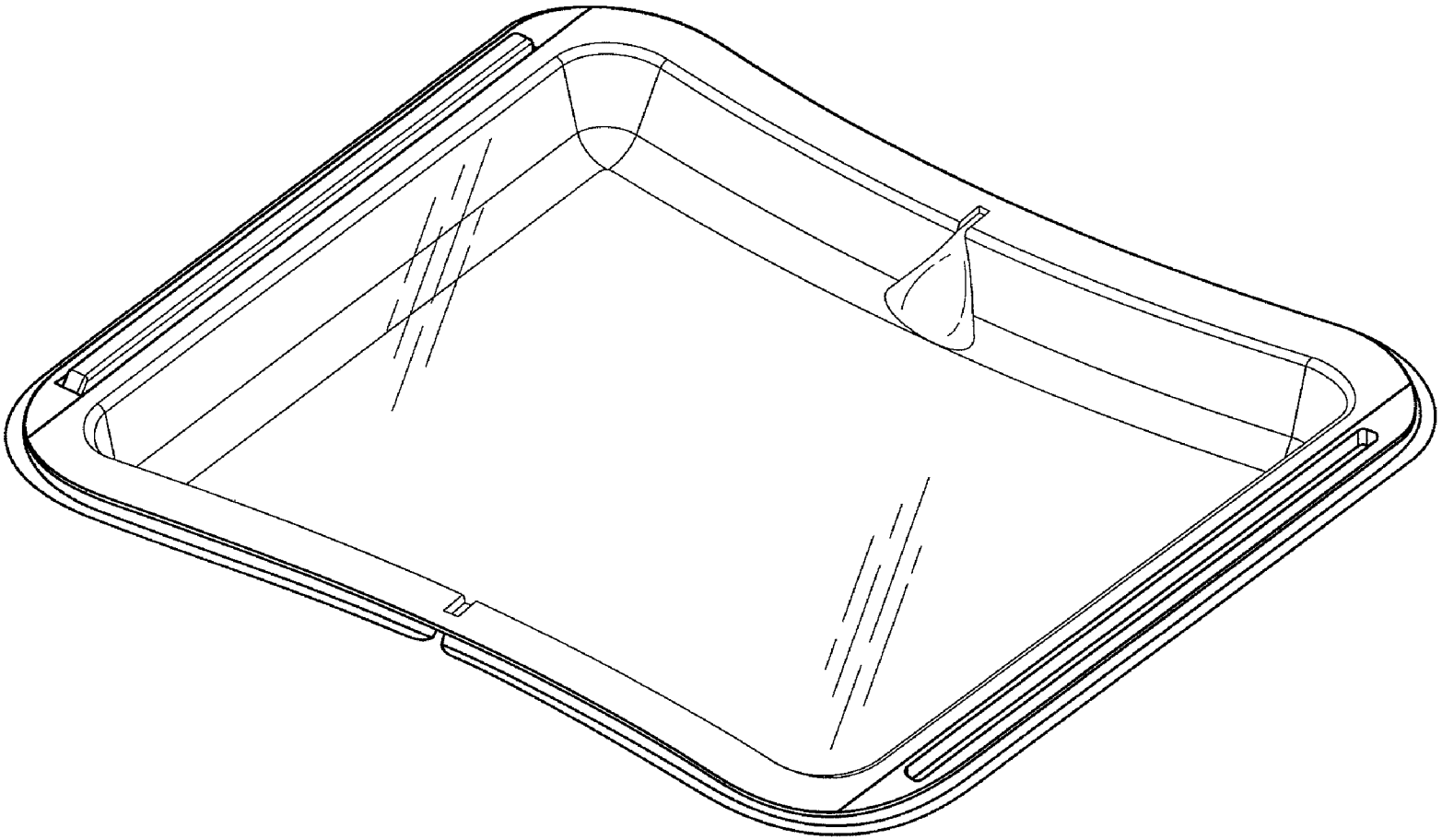
Figure 12A:
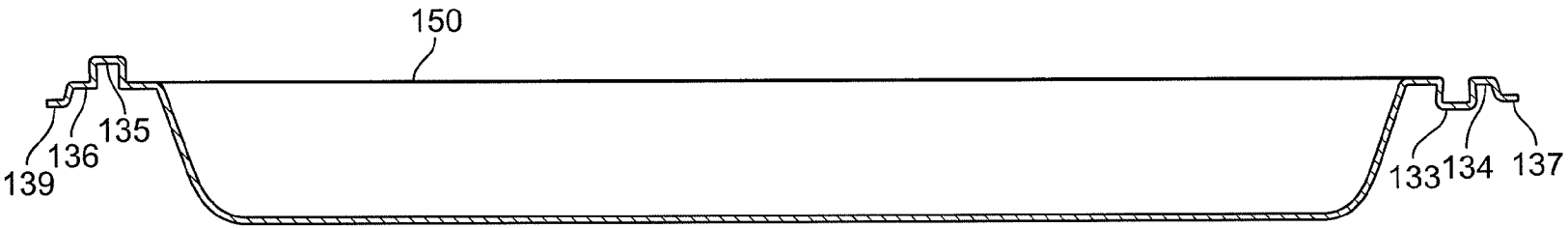
FIG. 12A-B are cross-sectional views of the container of FIGS. 11A-B, as depicted in the open configuration and the closed configuration, respectively.
Figure 12B:
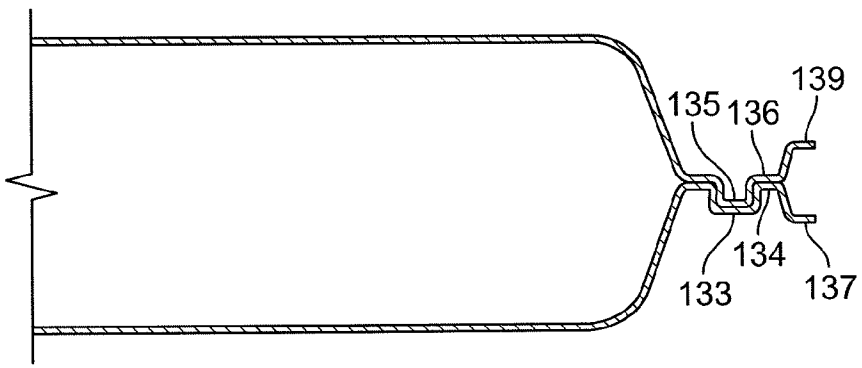

In an alternative embodiment, as shown in FIGS. 11A-B, the removable cover member 50 can be attached to the rim 30 such that the removable cover member 50 does not extend over the fastener assembly (i.e. seal 33, 35; flex regions 34, 36; and closures 37, 39). FIGS. 12A-B depicts a cross-sectional view of this configuration, in which the boundary edge of the removable cover member 150 is positioned inward of the fastener assembly. In this configuration, the removable cover member 150 can remain attached to the container while the container is converted into the closed position, wherein the fastener assemblies are brought into engagement such that protrusion 135 is inserted within recess 133 to form a seal.

Additionally, the removable cover member 50 can be attached to the rim 30 around the entire periphery of the cover member 50, or alternatively the cover member 50 can be attached only at select locations, as desired. An additional benefit of the removable cover member 50 embodiments is that the cover member itself serves as a tamper evident feature in that any defect in the cover member 50 or breach in the union between the cover member and the rim will be readily apparent to the consumer.

Figure 13:
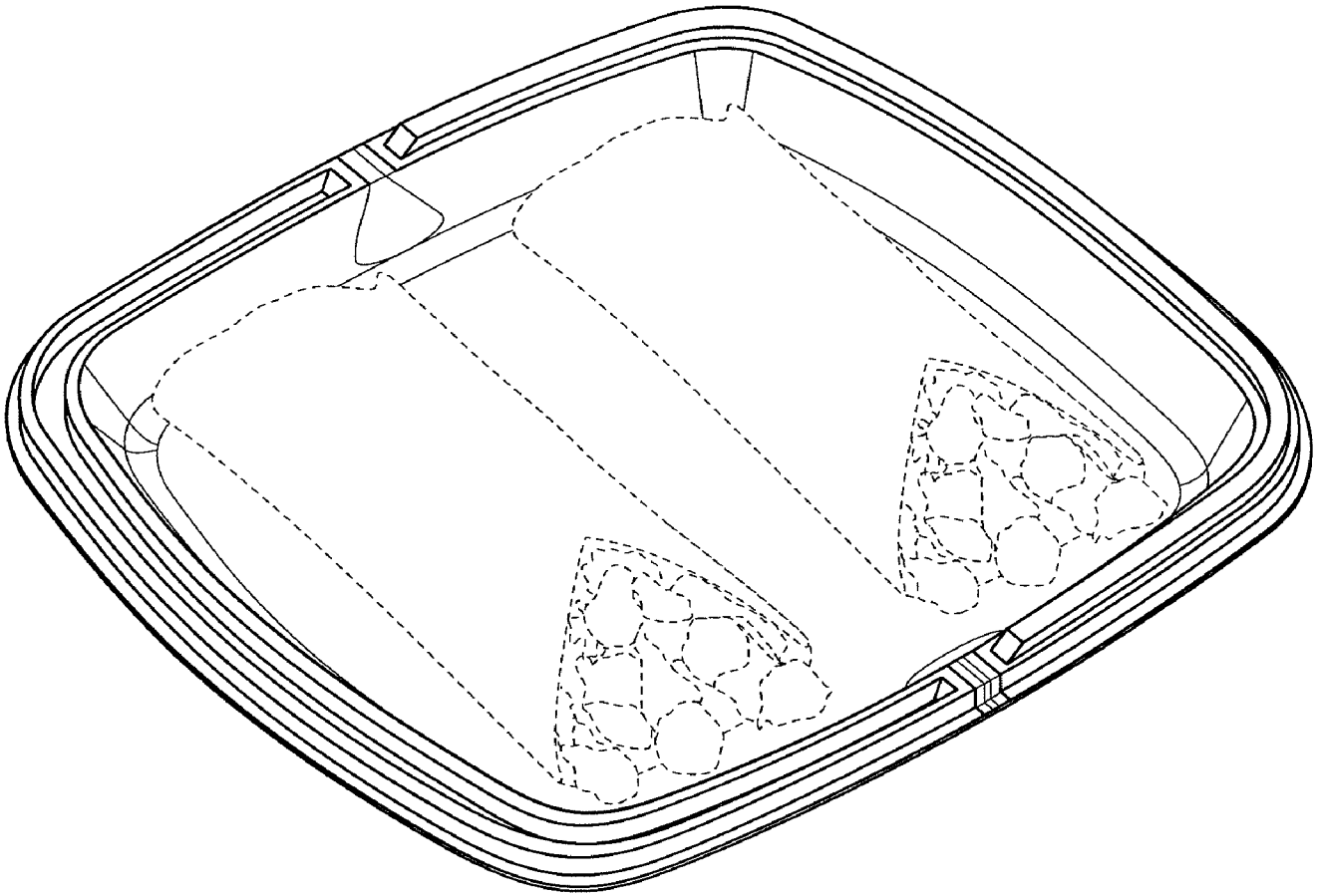
FIG. 13 is a perspective view of a representative embodiment of packaged product including a foldable container and exemplary food product in accordance with the disclosed subject matter.

Food items can be positioned on both portions 12, 14 of the container, as shown in FIG. 13, or alternatively the food item can be positioned on only one portion. In either configuration, one portion can rotate or pivot about the transition region and serve as a lid. In some embodiments, the containers can be formed having multiple compartments formed in the base 10 (not shown). Such containers are desirable for placing food items in different compartments to prevent or inhibit commingling of items. Undesirable mixing of food items can corrupt the flavor, consistency, or visual appeal of the food items.

Figure 14B:
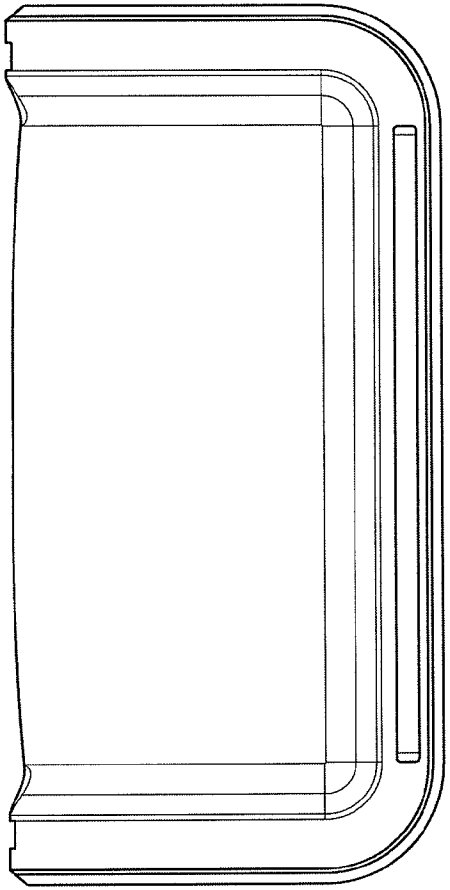
FIGS. 14A-D are top views of the foldable container of FIGS. 11A-B, as shown in the open configuration and in the closed configurations supported vertically at different orientations.
Figure 14A:
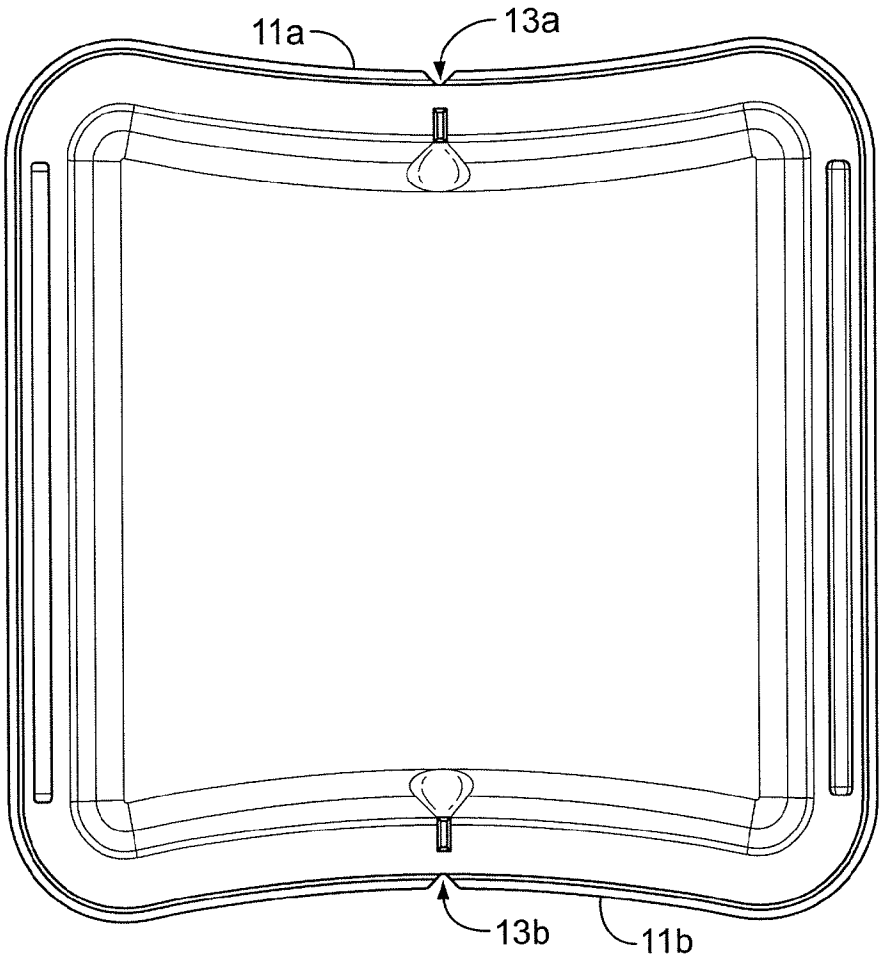
Figure 14C:
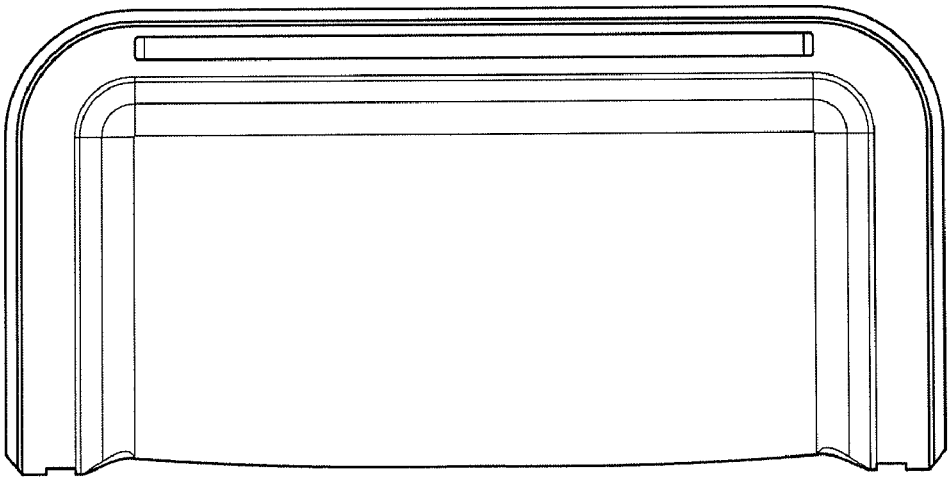
Figure 14D:
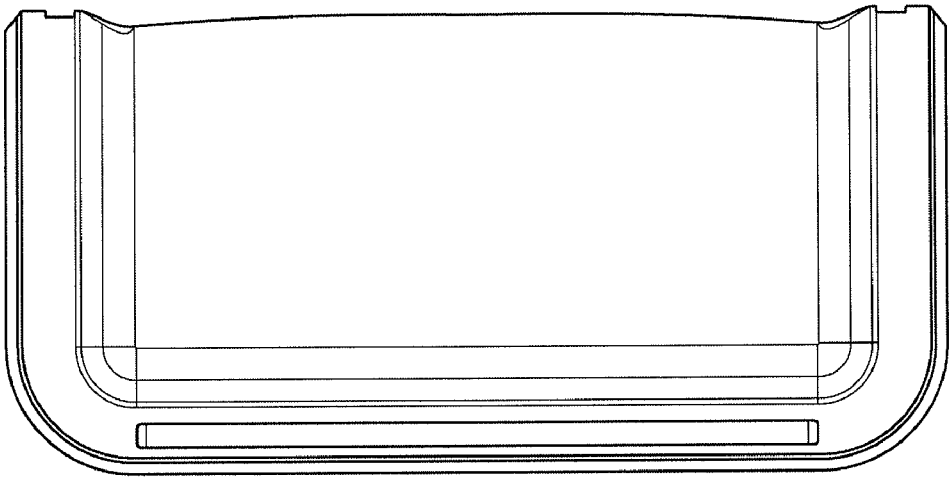

Based upon the disclosure above, a number of variations of the container shape, size and configuration are possible to serve the intended purpose as described. For example, and with reference to the embodiment of FIGS. 14A-D, the sidewall of the container can define a plurality of sides, wherein at least one side has a non-linear configuration when the first base portion is in the open position and a substantially linear configuration when the first base portion is in the closed position. That is, sides 11*a-b* are curved as shown in FIGS. 14A-D, when in the open position, but deform when the container is moved to the closed position to define a straight edge. The straight edge allows for the container to be arranged in an upright position for storage and display. Also, the sides 11*a-b* can include surface breaks 13*a-b* at a location which corresponds to the transition region. These notches 13*a-b* assist in folding the container, yet do not traverse across the entire rim section and thereby do not allow fluid or debris to pass through the container. This configuration allows the container can be arranged in an upright position from any side of the container, including a side having the transition region, notches, surface breaks, as shown in FIG. 14C, or other areas of weakness.

The containers disclosed herein are preferably disposable, but it is contemplated that they may be reused at a future time. Also, the container can be constructed from materials suitable to be placed in a heating apparatus, such as a microwave, to heat the food and/or used for storage in the refrigerator or freezer. Additionally, the materials from which the food container 100 is made need not be the same throughout.

The containers described herein can be manufactured from any suitable material, for example, expanded polystyrene foam, oriented polystyrene (OPS), polypropylene, mineral filled polypropylene, amorphous polyethylene terephthalate (APET), thermoplastics, and paper. It is to be understood that the foregoing list is not exhaustive, and that the containers can be made from other materials.

It is to be recognized that the dimensions and relative proportions of the base 10, sidewall 20, and rim 30 of the food container 100 will vary according to the exact size and intended use of the food container 100. While an essentially square food container 100 is illustrated in FIG. 1, one of ordinary skill will recognize that any suitable shape and depth of food container 100 can be employed and the disclosed subject matter is not so limited. Other suitable shapes include triangles, rectangles, ovals, various polygons, etc.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A foldable container comprising:

a base including a first base portion and an opposing second base portion, the base having a base surface free of hinge lines between the first base portion and the second base portion;

a sidewall surrounding at least a potion of the base and extending generally upwardly a distance to define a non-uniform sidewall height, the sidewall having an inner reference surface and a top edge; and a rim surrounding the base to define a compartment therein, the rim having a first rim portion corresponding with the first base portion and an opposing second rim portion corresponding with the second base portion;

the sidewall having at least one transition region formed therein to allow the first base portion to pivot between an open position and a closed position, the first base portion defining at least a portion of a cover relative to the second base portion when in the closed position.

2. The foldable container of claim 1, wherein the sidewall has a continuously varying height.

3. The foldable container of claim 1, further comprising an intermediate portion surrounding the base, the intermediate portion disposed adjacent the base.

4. The foldable container of claim 3, wherein the first rim portion includes a segment disposed proximate a top edge of the intermediate portion.

5. The foldable container of claim 3, wherein the second rim portion is disposed proximate a top edge of the sidewall.

6. The foldable container of claim 1, wherein the transition region has a contoured surface when the first base portion is in the open position.

7. The foldable container of claim 6, wherein the contoured surface of the transition region is convex relative to the inner reference surface of the sidewall.

8. The foldable container of claim 1, wherein the transition region defines a boundary edge with the inner reference surface of the sidewall.

9. The foldable container of claim 8, wherein the boundary edge includes a line of weakness.

10. The foldable container of claim 1, wherein the transition region includes a variation in a property of the sidewall, the variation in property including at least one of a variation in material, thickness, or strength.

11. The foldable container of claim 1, wherein a portion of the base between the first base portion and the second base portion has a generally arcuate configuration when the first base portion is in the closed position.

12. The foldable container of claim 1, further comprising a hinge defined between the first rim portion and the second rim portion.

13. The foldable container of claim 12, wherein the hinge includes a groove formed in the rim.

14. The foldable container of claim 1, further comprising a fastener disposed proximate at least one of the first rim portion or the second rim portion to maintain the first base portion in the closed position.

15. The foldable container of claim 1, wherein the first rim portion and the second rim portion form a substantially leak-resistant seal therebetween when the first base portion is in the closed position.

16. The foldable container of claim 1, wherein the base is oriented at an angle with respect to the rim, when in the open position.

17. The foldable container of claim 1, wherein the rim includes at least one venting feature.

18. The foldable container of claim 17, wherein the venting feature is a recess or slot.

19. The foldable container of claim 1, wherein the base includes at least one product centering feature.

20. The foldable container of claim 1, further comprising a cover member removably attached to the rim.

* * * * *